US009111740B2

(12) United States Patent
Brown et al.

(10) Patent No.: US 9,111,740 B2
(45) **Date of Patent: *Aug. 18, 2015**

(54) ELECTRON TRANSFER DISSOCIATION DEVICE

(71) Applicant: Micromass UK Limited, Manchester (GB)

(72) Inventors: Jeffery Mark Brown, Hyde (GB); Martin Raymond Green, Altrincham (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/056,622

(22) Filed: Oct. 17, 2013

(65) Prior Publication Data

US 2014/0042314 A1 Feb. 13, 2014

Related U.S. Application Data

(63) Continuation of application No. 13/645,910, filed on Oct. 5, 2012, now Pat. No. 8,563,921, which is a continuation of application No. 12/937,806, filed as application No. PCT/GB2009/000902 on Apr. 3, 2009, now Pat. No. 8,283,626.

(60) Provisional application No. 61/049,495, filed on May 1, 2008.

(30) Foreign Application Priority Data

Apr. 14, 2008 (GB) ..... 0806725.8

(51) Int. Cl.
*H01J 49/28* (2006.01)
*H01J 49/00* (2006.01)
*H01J 49/06* (2006.01)

(52) U.S. Cl.
CPC ..... *H01J 49/28* (2013.01); *H01J 49/0072* (2013.01); *H01J 49/065* (2013.01)

(58) Field of Classification Search
CPC H01J 49/0045; H01J 49/0072; H01J 49/0077
USPC ..... 250/281–300
See application file for complete search history.

(56) References Cited

U.S. PATENT DOCUMENTS

| | | | |
|---|---|---|---|
| 6,627,875 | B2 | 9/2003 | Afeyan et al. |
| 6,649,907 | B2 | 11/2003 | Ebeling et al. |
| 6,737,641 | B2 | 5/2004 | Kato |
| 6,794,641 | B2 | 9/2004 | Bateman et al. |
| 6,800,846 | B2 | 10/2004 | Bateman et al. |

(Continued)

OTHER PUBLICATIONS

Olsen et al. 'Higher-energy C-trap dissociation for peptide modification analysis', Aug. 26, 2007, Nature Methods, vol. 4, pp. 709-712.*

*Primary Examiner* — Robert Kim
*Assistant Examiner* — Eliza Osenbaugh-Stewar
(74) *Attorney, Agent, or Firm* — Diederiks & Whitelaw, PLC

(57) ABSTRACT

A mass spectrometer is disclosed comprising an Electron Transfer Dissociation device comprising an ion guide. A control system determines the degree of fragmentation and charge reduction of precursor ions within the ion guide and varies the speed at which ions are transmitted through the ion guide in order to optimize the fragmentation and charge reduction process.

32 Claims, 15 Drawing Sheets

(56) References Cited

U.S. PATENT DOCUMENTS

| | | | | |
|---|---|---|---|---|
| 6,852,971 | B2 | 2/2005 | Baba et al. | |
| 7,026,610 | B2 | 4/2006 | Kato | |
| 7,145,139 | B2 | 12/2006 | Syka | |
| 7,319,222 | B2 | 1/2008 | Hashimoto et al. | |
| 7,397,026 | B2 | 7/2008 | Dowell | |
| 7,829,851 | B2 | 11/2010 | Mcluckey et al. | |
| 7,842,917 | B2 | 11/2010 | Mcluckey et al. | |
| 8,164,052 | B2 | 4/2012 | Green et al. | |
| 8,362,424 | B2 | 1/2013 | Brown et al. | |
| 8,389,932 | B2 | 3/2013 | Li et al. | |
| 8,410,437 | B2 | 4/2013 | Brown et al. | |
| 8,563,921 | B2 * | 10/2013 | Brown et al. | 250/281 |
| 8,624,179 | B2 | 1/2014 | Chen et al. | |
| 2005/0178958 | A1 * | 8/2005 | Bateman et al. | 250/287 |
| 2005/0199804 | A1 * | 9/2005 | Hunt et al. | 250/290 |
| 2006/0255261 | A1 | 11/2006 | Whitehouse et al. | |
| 2011/0215237 | A1 | 9/2011 | Bateman | |

* cited by examiner

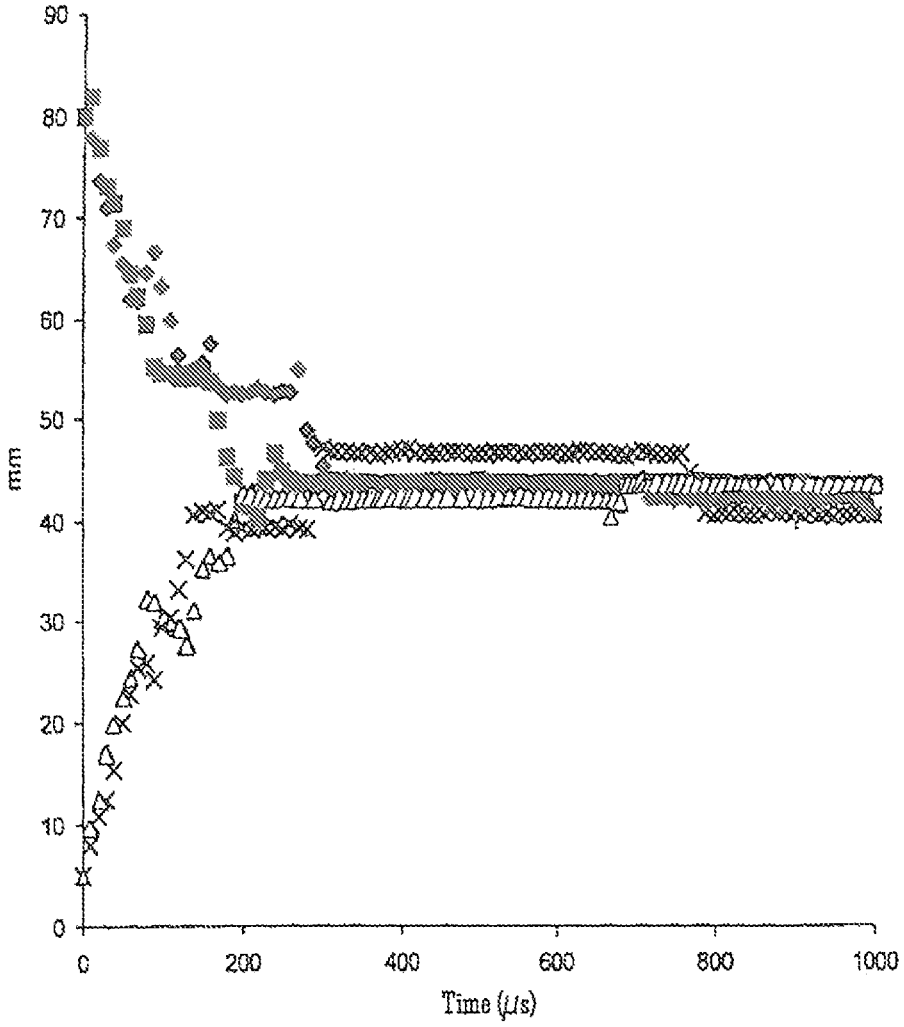
FIG. 5
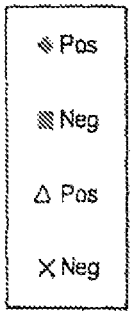

100
%
0
449.9
450.2
450.6
450.9
451.2
452.0
466.2
470.0
472.0
487.0
496.3
524.3
552.3
552.8
553.3
597.3
608.3
609.8
624.4
652.8
661.3
665.3
666.8
667.3
674.8
675.8
676.3
m/z

100
%
0
450.2
450.6
450.9
451.2
452.0
471.0
472.0
487.0
552.8
608.8
624.4
652.3
660.9
666.3
674.8
m/z

100
%
0
450.2
450.6
450.9
451.2
452.0
468.1
469.0
470.0
472.0
674.8
440 450 460 470 480 490 500 510 520 530 540 550 560 570 580 590 600 610 620 630 640 650 660 670 680 690
m/z

ELECTRON TRANSFER DISSOCIATION DEVICE

CROSS REFERENCE TO RELATED APPLICATIONS

This application is a continuation of U.S. patent application Ser. No. 13/645,910 filed Oct. 5, 2012 which is a continuation of Ser. No. 12/937,806 filed Nov. 18, 2010, which is the National Stage of International Application No. PCT/GB2009/000902, filed Apr. 3, 2009, which claims priority to and benefit of United Kingdom Patent Application No. 0806725.8, filed Apr. 14, 2008 and U.S. Provisional Patent Application Ser. No. 61/049,495, filed May 1, 2008. The entire contents of these applications are incorporated herein by reference.

BACKGROUND OF THE INVENTION

The present invention relates to a method of mass spectrometry and a mass spectrometer for the acquisition of optimized Electron Transfer Dissociation ("ETD") data.

The present invention relates to an ion-ion reaction or fragmentation device and a method of performing ion-ion reactions or fragmentation. The present invention also relates to an Electron Transfer Dissociation and/or Proton Transfer Reaction device. Analyte ions may be fragmented either by ion-ion reactions or by ion-neutral gas reactions. Analyte ions and/or fragment ions may also be charge reduced by Proton Transfer or Electron Transfer.

Electrospray ionisation ion sources are well known and may be used to convert neutral peptides eluting from an HPLC column into gas-phase analyte ions. In an aqueous acidic solution, tryptic peptides will be ionised on both the amino terminus and the side chain of the C-terminal amino acid. As the peptide ions proceed to enter a mass spectrometer the positively charged amino groups hydrogen bond and transfer protons to the amide groups along the backbone of the peptide.

It is known to fragment peptide ions by increasing the internal energy of the peptide ions through collisions with a collision gas. The internal energy of the peptide ions is increased until the internal energy exceeds the activation energy necessary to cleave the amide linkages along the backbone of the molecule. This process of fragmenting ions by collisions with a neutral collision gas is commonly referred to as Collision Induced Dissociation ("CID"). The fragment ions which result from Collision Induced Dissociation are commonly referred to as b-type and y-type fragment or product ions, wherein b-type fragment ions contain the amino terminus plus one or more amino acid residues and y-type fragment ions contain the carboxyl terminus plus one or more amino acid residues.

Other methods of fragmenting peptides are known. An alternative method of fragmenting peptide ions is to interact the peptide ions with thermal electrons by a process known as Electron Capture Dissociation ("ECD"). Electron Capture Dissociation cleaves the peptide in a substantially different manner to the fragmentation process which is observed with Collision Induced Dissociation. In particular, Electron Capture Dissociation cleaves the backbone N—$C_\alpha$ bond or the amine bond and the resulting fragment ions which are produced are commonly referred to as c-type and z-type fragment or product ions. Electron Capture Dissociation is believed to be non-ergodic i.e. cleavage occurs before the transferred energy is distributed over the entire molecule. Electron Capture Dissociation also occurs with a lesser dependence on the nature of the neighbouring amino acid and only the N-side of proline is 100% resistive to Electron Capture Dissociation cleavage.

One advantage of fragmenting peptide ions by Electron Capture Dissociation rather than by Collision Induced Dissociation is that Collision Induced Dissociation suffers from a propensity to cleave Post Translational Modifications ("PTMs") making it difficult to identify the site of modification. By contrast, fragmenting peptide ions by Electron Capture Dissociation tends to preserve Post. Translational Modifications arising from, for example, phosphorylation and glycosylation.

However, the technique of Electron Capture Dissociation suffers from the significant problem that it is necessary simultaneously to confine both positive ions and electrons at near thermal kinetic energies. Electron Capture Dissociation has been demonstrated using Fourier Transform Ion Cyclotron Resonance ("FT-ICR") mass analysers which use a superconducting magnet to generate large magnetic fields. However, such mass spectrometers are very large and are prohibitively expensive for the majority of mass spectrometry users.

As an alternative to Electron Capture Dissociation it has been demonstrated that it is possible to fragment peptide ions by reacting negatively charged reagent ions with multiply charged analyte cations in a linear ion trap. The process of reacting positively charged analyte ions with negatively charged reagent ions has been referred to as Electron Transfer Dissociation ("ETD"). Electron Transfer Dissociation is a mechanism wherein electrons are transferred from negatively charged reagent ions to positively charged analyte ions. After electron transfer, the charge-reduced peptide or analyte ion dissociates through the same mechanisms which are believed to be responsible for fragmentation by Electron Capture Dissociation i.e. it is believed that Electron Transfer Dissociation cleaves the amine bond in a similar manner to Electron Capture Dissociation. As a result, the product or fragment ions which are produced by Electron Transfer Dissociation of peptide analyte ions comprise mostly c-type and z-type fragment or product ions.

One particular advantage of Electron Transfer Dissociation is that such a process is particularly suited for the identification of post-translational modifications (PTMs) since weakly bonded PTMs like phosphorylation or glycosylation will survive the electron induced fragmentation of the backbone of the amino acid chain.

At present Electron Transfer Dissociation has been demonstrated by mutually confining cations and anions in a 2D linear ion trap which is arranged to promote ion-ion reactions between reagent anions and analyte cations. The cations and anions are simultaneously trapped within the 2D linear ion trap by applying an auxiliary axially confining RF pseudo-potential barrier at both ends of the 2D linear quadrupole ion trap. However, this approach is problematic since the effective RF pseudo-potential barrier height observed by an ion within the ion trap will be a function of the mass to charge ratio of the ion. As a result, the mass to charge ratio range of analyte and reagent ions which can be confined simultaneously within the ion trap in order to promote ion-ion reactions is somewhat limited.

Another method of performing Electron Transfer Dissociation is known wherein a fixed DC axial potential is applied at both ends of a 2D linear quadrupole ion trap in order to confine ions having a certain polarity (e.g. reagent anions) within the ion trap. Ions having an opposite polarity (e.g. analyte cations) to those confined within the ion trap are then directed into the ion trap. The analyte cations will react with the reagent anions already confined within the ion trap. However, the axial DC barriers which are used to retain the reagent anions within the ion trap will also have an opposite effect of acting as an accelerating potential to the analyte cations which are introduced into the ion trap. As a result, there will be a large kinetic energy difference or mismatch between the reagent anions and the analyte cations such that any ion-ion reactions which may occur will occur in a sub-optimal manner.

It is known that when multiply charged (analyte) cations are mixed with (reagent) anions then loosely bound electrons may be transferred from the (reagent) anions to the multiply charged (analyte) cations. Energy is released into the multiply charged cations and the multiply charged cations may be caused to dissociate. However, a significant proportion of the (analyte) cations may not dissociate but may instead be reduced in charge state. The cations may be reduced in charge by one of two processes. Firstly, the cations may be reduced in charge by Electron Transfer ("ET") of electrons from the anions to the cations. Secondly, the cations may be reduced in charge by Proton Transfer ("PT") of protons from the cations to the anions. Irrespective of the process, an abundance of charged reduced product ions are observed within mass spectra indicating the degree of ion-ion reactions (either ET or PT) that are occurring.

In bottom-up or top-down proteomics Electron Transfer Dissociation experiments may be performed in order to maximize the information available by maximizing the abundance of dissociated product ions within mass spectra. The degree of Electron Transfer Dissociation fragmentation depends upon the conformation of the cations (and anions) together with many other instrumental factors. It can be difficult to know a priori the optimal parameters for every anion-cation combination from an LC run.

It is desired to provide an improved method of and apparatus for performing Electron Transfer Dissociation and/or Proton Transfer Reaction.

BRIEF SUMMARY OF THE INVENTION

According to an aspect of the present invention there is provided a mass spectrometer comprising:

an Electron Transfer Dissociation and/or Proton Transfer Reaction device comprising an ion guide comprising a plurality of electrodes; and a control system arranged and adapted to estimate, determine or measure the degree to which at least some first ions are fragmented and/or reduced in charge due to Electron Transfer Dissociation and/or Proton Transfer Reaction as the first ions are transmitted through the ion guide and in response thereto to vary, alter, increase or decrease one or more parameters which affect the transmission and/or degree of fragmentation and/or degree of charge reduction of the first ions as the first ions pass through the ion guide.

The first ions preferably comprise either: (i) anions or negatively charged ions; (ii) cations or positively charged ions; or (iii) a combination or mixture of anions and cations.

In a mode of operation the control system is preferably arranged and adapted to vary, alter, increase or decrease the one or more parameters in order to optimise and/or maximise the fragmentation and/or charge reduction of the first ions as the first ions pass through the ion guide.

In another mode of operation the control system may be arranged and adapted to vary, alter, increase or decrease the one or more parameters in order to minimise and/or reduce the fragmentation and/or charge reduction of the first ions so that the ion guide is operated in an ion guiding mode wherein ions received at the input to the ion guide are substantially onwardly transmitted to the output of the ion guide without substantially being subjected to fragmentation and/or charge reduction.

The control system is preferably arranged and adapted to vary, alter, increase or decrease the one or more parameters so as to vary, alter, increase or decrease the speed or velocity at which the first ions are transmitted, in use, through the ion guide.

The mass spectrometer preferably further comprises a first device which drives or urges, in use, at least some of the first ions to pass through and/hr along the ion guide.

According to a less preferred embodiment the first device may be arranged and adapted either: (i) to generate a linear axial DC electric field along at least a portion or along at least 1%, 5%, 10%, 20%, 30%, 40%, 50%, 60%, 70%, 80%, 90%, 95% or 100% of the axial length of the ion guide; or (ii) to generate a non-linear or stepped axial DC electric field along at least a portion or along at least 1%, 5%, 10%, 20%, 30%, 40%, 50%, 60%, 70%, 80%, 90%, 95% or 100% of the axial length of the ion guide.

According to an embodiment the control system may be arranged and adapted to vary, alter, increase or decrease the axial DC electric field or the gradient of the axial DC electric field in order to maximise, optimise or minimise the degree of fragmentation of ions by ETD.

According to the preferred embodiment the first device is arranged and adapted to apply one or more first transient DC voltages or potentials or one or more first transient DC voltage or potential waveforms to at least some of the plurality of electrodes in order to drive or urge at least some first ions along and/or through at least a portion of the axial length of the ion guide in a first direction.

The control system is preferably arranged and adapted to vary, alter, increase or decrease the speed or velocity at which the one or more first transient DC voltages or potentials or the one or more first transient DC voltage or potential waveforms are applied to at least some of the plurality of electrodes and/or are translated along the length of the ion guide in order to maximise, optimise or minimise the degree of fragmentation of ions by ETD.

According to an embodiment the control system may be arranged and adapted to vary, alter, increase or decrease the amplitude, height or depth of the one or more first transient DC voltages or potentials or the one or more first transient DC voltage or potential waveforms in order to maximise, optimise or minimise the degree of fragmentation of ions by ETD.

According to a less preferred embodiment the control system may be arranged and adapted to vary, alter, increase or decrease the periodicity and/or shape and/or waveform and/or pattern and/or profile and/or mark space ratio of the one or more first transient DC voltages or potentials or the one or more first transient DC voltage or potential waveforms which are applied to the electrodes in order to maximise, optimise or minimise the degree of fragmentation of ions by ETD.

The first device is preferably arranged and adapted to apply the one or more first transient DC voltages or potentials or the one or more first transient DC voltage or potential waveforms to at least some or 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the plurality of electrodes in order to drive or urge at least some the first ions along and/or through at least some or 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of the ion guide in a first direction.

According to a further embodiment the mass spectrometer may further comprise a second device arranged and adapted to apply one or more second transient DC voltages or potentials or one or more second transient DC voltage or potential waveforms to at least some of the plurality of electrodes in order to drive or urge at least some second ions along and/or through at least a portion of the axial length of the ion guide in a second different direction.

The control system may be arranged and adapted to vary, alter, increase or decrease the speed or velocity at which the one or more second transient DC voltages or potentials or the one or more second transient DC voltage or potential waveforms are applied to at least some of the plurality of electrodes and/or are translated along the length of the ion guide in order to maximise, optimise or minimise the degree of fragmentation of ions by ETD.

According to an embodiment the control system may be arranged and adapted to vary, alter, increase or decrease the amplitude, height or depth of the one or more second transient DC voltages or potentials or the one or more second transient DC voltage or potential waveforms in order to maximise, optimise or minimise the degree of fragmentation of ions by ETD.

The control system may according to a less preferred embodiment be arranged and adapted to vary, alter increase or decrease the periodicity and/or shape and/or waveform and/or pattern and/or profile and/or mark space ratio of the one or more second transient DC voltages or potentials or the one or more second transient DC voltage or potential waveforms in order to maximise, optimise or minimise the degree of fragmentation of ions by ETD.

The second device is preferably arranged and adapted to apply the one or more second transient DC voltages or potentials or the one or more second transient DC voltage or potential waveforms to at least some or 0-5%, 540%, 10-15%, 15-20%, 20-25%, 25-30% 30-35%, 35-40%, 40-45%, 45-50%, 50-55%, 55-60%, 60-65%, 65-70%, 70-75%, 75-80%, 80-85%, 85-90%, 90-95% or 95-100% of the plurality of electrodes in order to drive or urge at least some the second ions along and/or through at least some or 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of the ion guide in the second direction.

According to an embodiment either (a) the second direction is substantially opposite to or counter to the first direction; or (b) the angle between the first direction and the second direction is selected from the group consisting of (i) <30°; (n) 30-60°; (in) 60-90° (iv) 90-120°; (v) 120-150°; (vi) 150-180°; and (vii) 180°.

According to an embodiment the second ions may comprise: (i) anions or negatively charged ions; (ii) cations or positively charged ions; or (iii) a combination or mixture of anions and cations.

The first ions preferably have a first polarity and the second ions preferably have a second polarity which is opposite to the first polarity.

According to an embodiment the mass spectrometer preferably further comprises a device for applying or maintaining a first positive or negative potential or potential difference at a first or upstream end of the ion guide, wherein the first positive or negative potential or potential difference preferably acts to confine, in use, at least some of the first ions and/or at least some of the second ions within the ion guide.

The first positive or negative potential or potential difference preferably allows at least some of the first ions and/or at least some of the second ions to exit the ion guide via the first or upstream end.

The control system may according to a less preferred embodiment be arranged and adapted to vary, alter, increase or decrease the first positive or negative potential or potential difference in order to vary, alter, increase or decrease the degree or amount of ion confinement within the ion guide in order to maximise, optimise or minimise the degree of fragmentation of ions by ETD.

The mass spectrometer may further comprise a device for applying a second positive or negative potential or potential difference at a second or downstream end of the ion guide, wherein the second positive or negative potential or potential difference preferably acts to confine, in use, at least some of the first ions and/or at least some of the second ions within the ion guide.

The second positive or negative potential or potential difference preferably allows at least some of the first ions and/or at least some of the second ions to exit the ion guide via the second or downstream end.

The control system may be arranged and adapted to vary, alter, increase or decrease the second positive or negative potential or potential difference in order to vary, alter, increase or decrease the degree or amount of ion confinement within the ion guide in order to maximise, optimise or minimise the degree of fragmentation of ions by ETD.

The mass spectrometer preferably further comprises a first RF device arranged and adapted to apply a first AC or RF voltage having a first frequency and a first amplitude to at least some of the plurality of electrodes such that, in use, ions are confined radially within the ion guide, wherein either (a) the first frequency is selected from the group consisting of: (i) <100 kHz; (u) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (b) the first amplitude is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (c) in a mode of operation adjacent or neighbouring electrodes are supplied with opposite phase of the first AC or RF voltage; and/or (d) the ion guide comprises 1-10, 10-20, 20-30, 30-40, 40-50, 50-60, 60-70, 70-80, 80-90, 90-100 or >100 groups of electrodes, wherein each group of electrodes comprises at least 1, 2, 3, 4, 5, 6, 7, 8, 9, 10, 11, 12, 13, 14, 15, 16, 17, 18, 19 or 20 electrodes and wherein at least 1, 2, 3, 4, 5, 6, 7, 8, 9, 10, 11, 12, 13, 14, 15, 16, 17, 18, 19 or 20 electrodes in each group are supplied with the same phase of the first AC or RF voltage.

The control system is preferably arranged and adapted to vary, alter, increase or decrease the first frequency and/or the first amplitude in order to vary, alter, increase or decrease the degree or amount of ion confinement and/or ion-ion interactions within the ion guide in order to maximise, optimise or minimise the degree of fragmentation of ions by ETD.

According to the preferred embodiment the control system is arranged and adapted to estimate, determine or measure the degree to which at least some of the first ions are fragmented and or reduced in charge by estimating, determining or measuring either (i) the intensity or abundance of one or more first parent, precursor, daughter, fragment, charged reduced or other ions observed within a mass spectrum, an ion mobility spectrum or other spectrum; or (ii) the intensity or abundance of one or more first parent, precursor, daughter, fragment, charged reduced or other ions observed within a first mass range or a first mass to charge ratio range of a mass spectrum, an ion mobility spectrum or other spectrum.

The control system is preferably arranged and adapted to estimate, determine or measure the degree to which at least some of the first ions are fragmented and/or reduced in charge by estimating, determining or measuring the intensity or abundance of one or more first parent, precursor, daughter, fragment, charged reduced or other ions within a first mass range or a first mass to charge ratio range of a mass spectrum or an ion mobility spectrum relative to the intensity or abundance of one or more second parent, precursor, daughter, fragment, charged reduced or others ions.

The first mass range or a first mass to charge ratio range preferably has a width in mass units or mass to charge ratio units selected from the group consisting of: (i) <10; (ii) 10-50; (iii) 50-100; (n) 100-200; (v) 200-300 (vi) 300-400; (vii) 400-500; (viii) 500-600; (ix) 600-700, (x) 700-800; (xi) 800-900; (xii) 900-1000; (xiii) 1000-1100, (xiv) 1100-1200; (xv) 1200-1300; (xvi) 1300-1400; (xvii) 1400-1500; (xviii) 1500-1600; (xix) 1600-1700; (xx) 1700-1800; (xxi) 1800-1900; (xxii) 1900-2000; and (xxiii) >2000.

The control system is according to a preferred embodiment arranged and adapted to vary, alter, increase or decrease the degree to which at least some of the first ions are fragmented and/or reduced in charge in order to maintain an ion abundance measurement, an ion intensity measurement or an ion ratio at a desired value and/or within a desired range.

The desired value and/or desired range is preferably selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.1; (xxii) 2.1-2.2; (xxiii) 2.2-2.3; (xxiv) 2.3-2.4; (xxv) 2.4-2.5; (xxvi) 2.5-2.6; (xxvii) 2.6-2.7; (xxviii) 2.7-2.8; (xxix) 2.8-2.9; (xxx) 2.9-3.0; (xxxi) 3.0-3.1; (xxxii) 3.1-3.2; (xxxiii) 3.2-3.3; (xxxiv) 3.3-3.4; (xxxv) 3.4-3.5; (xxxvi) 3.5-3.6; (xxxvii) 3.6-3.7; (xxxii 3.7-3.8; (xxxix) 3.8-3.9; (xl) 3.9-4.0; (xli) 4.0-4.1; (xlii) 4.1-4.2; (xliii) 4.2-4.3; (xliv) 4.3-4.4; (xlv) 4.4-4.5; (xlvi) 4.5-4.6; (xlvii) 4.6-4.7; (xlviii) 4.7-4.8; (xlix) 4.8-4.9; (l) 4.9-5.0; and (li) >5.0.

If the control system determines that an ion abundance measurement, an ion intensity measurement or an ion ratio is relatively high or exceeds a threshold then the control system is preferably arranged and adapted to vary, alter, increase or decrease the one or more parameters so as to reduce the ion abundance measurement, the ion intensity measurement or the ion ratio.

If the control system determines that an ion abundance measurement, an ion intensity measurement or an ion ratio is relatively low or falls below a threshold then the control system is preferably arranged and adapted to vary, alter, increase or decrease the one or more parameters so as to increase the ion abundance measurement, the ion intensity measurement or the ion ratio.

The ion guide preferably comprises a plurality of electrodes having at least one aperture, wherein ions are transmitted in use through the apertures.

According to an embodiment at least 1%, 5%, 10%, 20%, 30%, 40%, 50%, 60%, 70%, 80%, 90%, 95% or 100% of the electrodes have substantially circular, rectangular, square or elliptical apertures.

According to an embodiment at least 1%, 5%, 10%, 20%, 30%, 40%, 50%, 60%, 70%, 80%, 90%, 95% or 100% of the electrodes have apertures which are substantially the same first size or which have substantially the same first area and/or at least 1%, 5%, 10%, 20%, 30%, 40%, 50%, 60%, 70%, 80%, 90%, 95% or 100% of the electrodes have apertures which are substantially the same second different size or which have substantially the same second different area.

According to an embodiment at least 1%, 5%, 10%, 20%, 30%, 40%, 50%, 60%, 70%, 80%, 90%, 95% or 100% of the electrodes have apertures which become progressively larger and/or smaller in size or in area in a direction along the axis of the ion guide.

According to an embodiment at least 1%, 5%, 10%, 20%, 30%, 40%, 50%, 60%, 70%, 80%, 90%, 95% or 100% of the electrodes have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to an embodiment at least 1%, 5%, 10%, 20%, 30%, 40%, 50%, 60%, 70%, 80%, 90%, 95% or 100% of the electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 turn; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm.

According to an embodiment at least some of the plurality of electrodes comprise apertures and wherein the ratio of the internal diameter or dimension of the apertures to the centre-to-centre axial spacing between adjacent electrodes is selected from the group consisting of (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0.

According to an embodiment the internal diameter of the apertures of the plurality of electrodes progressively increases or decreases and then progressively decreases or increases one or more times along the longitudinal axis of the ion guide.

According to an embodiment the plurality of electrodes define a geometric volume, wherein the geometric volume is selected from the group consisting of: (i) one or more spheres; (u) one or more oblate spheroids; (in) one or more prolate spheroids; (iv) one or more ellipsoids; and (v) one or more scalene ellipsoids.

According to an embodiment the ion guide has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

According to an embodiment the ion guide comprises at least: (i) 1-10 electrodes; (ii) 10-20 electrodes; (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-

110 electrodes; (xii) 110-120 electrodes; (xiii) 120-130 electrodes; (xiv) 130-140 electrodes; (xv) 140-150 electrodes; (xvi) 150-160 electrodes; (xvii) 160-170 electrodes; (xviii) 170-180 electrodes; (xix) 180-190 electrodes; (xx) 190-200 electrodes; and (xxi) >200 electrodes.

According to an embodiment at least 1%, 5%, 10%, 20%, 30%, 40%, 50%, 60%, 70%, 80%, 90%, 95% or 100% of the electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm, (xii) less than or equal to 0.4 mm; (xiii) less than or equal to 0.2 mm; (xiv) less than or equal to 0.1 mm; and (xv) less than or equal to 0.25 mm.

According to an embodiment the pitch or axial spacing of the plurality of electrodes progressively decreases or increases one or more times along the longitudinal axis of the ion guide.

According to a less preferred embodiment the ion guide may comprise a plurality of segmented rod electrodes.

According to a less preferred embodiment the ion guide may comprise: one or more first electrodes; one or more second electrodes; and one or more layers of intermediate electrodes arranged in a plane in which ions travel in use, wherein the one or more layers of intermediate electrodes are arranged between the one or more first electrodes and the one or more second electrodes, wherein the one or more layers of intermediate electrodes comprise one or more layers of planar or plate electrodes, and wherein the one or more first electrodes are the uppermost electrodes and the one or more second electrodes are the lowermost electrodes.

According to an embodiment: (a) a static ion-ion reaction region, ion-neutral gas reaction region or reaction volume is formed or generated in the ion guide; or (b) a dynamic ion-ion reaction region, ion-neutral gas reaction region or reaction volume is formed or generated in the ion guide.

The mass spectrometer preferably further comprises a device arranged and adapted either: (a) to maintain the ion guide in a mode of operation at a pressure selected from the group consisting of (i) <100 mbar; (ii) <10 mbar; (iii) <1 mbar; (iv) <0.1 mbar; (v) <0.01 mbar; (vi) <0.001 mbar; (vii) <0.0001 mbar; and (viii) <0.00001 mbar; and/or (b) to maintain the ion guide in a mode of operation at a pressure selected from the group consisting of (i) >100 mbar; (ii) >10 mbar; (iii) >1 mbar; (iv) >0.1 mbar; (v) >0.01 mbar; (vi) >0.001 mbar; and (vii) >0.0001 mbar; and/or (c) to maintain the ion guide in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar, and (vii) 100-1000 mbar.

According to an embodiment the residence, transit or reaction time of at least 1%, 5%, 10%, 20%, 30%, 40%, 50%, 60%, 70%, 80%, 90%, 95% or 100% of the first ions within the ion guide is selected from the group consisting of (i) <1 ms; (ii) 1-5 ms; (iii) 5-10 ms; (iv) 10-15 ms; (v) 15-20 ms; (vi) 20-25 ms; (vii) 25-30 ms; 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ma; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms, (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms.

According to an embodiment the residence, transit or reaction time of at least 1%, 5%, 10%, 20% 30%, 40%, 50%, 60%, 70%, 80%, 90%, 95% or 100% of the second ions within the ion guide is selected from the group consisting of (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ma; (xiv) 60-65 ms; (xv) 65-70 ms; (xvi) 70-75 ms; (xvii) 75-80 ms; (xviii) 80-85 ms (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxiii) 155-160 ms (xxxiv) 160-165 ms; (xv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms.

According to an embodiment the residence, transit or reaction time of at least 1%, 5%, 10%, 20%, 30%, 40%, 50%, 60%, 70%, 80%, 90%, 95% or 100% of product or fragment ions created or formed within the ion guide is selected from the group consisting of (i) <1 ms; (ii) 1-5 ms; (iii) 5-10 ms; (iv) 10-15 ms, (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms, (xvi) 70-75 ms; (xvii) 75-80 ms; (xviii) 80-85 ms, (xix) 85-90 ms, (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms.

According to an embodiment the ion guide has a cycle time selected, from the group consisting of (i) <1 ms; (ii) 1-10 ms; (iii) 10-20 ms; (iv) 20-30 ms; (V) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment: (a) in a mode of operation first ions and/or second ions are arranged and adapted to be trapped but not substantially fragmented and/or reacted and/or charge reduced within the ion guide; and/or (b) in a mode of operation first ions and/or second ions are arranged and adapted to be collisionally cooled or substantially thermalised within the ion guide; and/or (c) in a mode of operation first ions and/or second ions are arranged and adapted to be substantially fragmented and/or reacted and/or charge reduced within the ion guide; and/or (d) in a mode of operation first ions and/or second ions are arranged and adapted to be pulsed into and/or out of the ion guide by means of one or more electrodes arranged at the entrance and/or exit of the ion guide.

According to an embodiment: (a) in a mode of operation ions are predominantly arranged to fragment by Collision Induced Dissociation to form product or fragment ions, wherein the product or fragment ions comprise a majority of b-type product or fragment ions and/or y-type product or fragment ions; and/or (b) in a mode of operation ions are predominantly arranged to fragment by Electron Transfer Dissociation to form product or fragment ions, wherein the product or fragment ions comprise a majority of c-type product or fragment ions and/or z-type product or fragment ions.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and loan product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment in order to effect Proton Transfer Reaction either: (i) protons are transferred from one or more multiply charged analyte cations or positively charged ions to one or more reagent anions or negatively charged ions whereupon at least some of the multiply charged analyte cations or positively charged ions are reduced in charge state and/or are induced to dissociate and form product or fragment ions; and/or (ii) protons are transferred from one or more multiply charged analyte cations or positively charged ions to one or more neutral, non-ionic or uncharged reagent gases or vapours whereupon at least some of the multiply charged analyte cations or positively charged ions are reduced in charge state and/or are induced to dissociate and form product or fragment ions.

The multiply charged analyte cations or positively charged ions preferably comprise peptides, polypeptides, proteins or biomolecules.

According to an embodiment in order to effect Proton Transfer Reaction either: (a) the reagent anions or negatively charged ions are derived from a compound selected from the group consisting of (i) carboxylic acid; (ii) phenolic; and (iii) a compound containing alkoxide; and/or (b) the reagent anions or negatively charged ions are derived from a compound selected from the group consisting of (i) benzoic acid; (ii) perfluoro-1,3-dimethylcyclohexane or PDCH; (iii) sulphur hexafluoride or SF6; and (iv) perfluorotributylamine or PFTBA; and/or (c) the one or more reagent gases or vapours comprise a superbase gas; and/or (d) the one or more reagent gases or vapours are selected from the group consisting of (i) 1,1,3,3-Tetramethylguanidine ("TMG"); (ii) 2,3,4,6,7,8,9,10-Octahydropyrimidol[1,2-a]azepine {Synonym: 1,8-Diazabicyclo[5.4.0]undec-7-ene ("DBU")}; or (iii) 7-Methyl-1,5,7-triazabicyclo[4.4.0]dec-5-ene ("MTBD"){Synonym: 1,3,4,6,78-Hexahydro-1-methyl-2H-pyrimido[1,2-a] pyrimidine}.

The mass spectrometer preferably further comprises an ion source arranged upstream and/or downstream of the Electron Transfer Dissociation or Proton Transfer Reaction device, wherein the ion source is selected from the group consisting of (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption ionisation ("MALDI") ion source; (v) a Laser Desorption ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) Thermospray ion source; (xix) an Atmospheric Sampling Glow Discharge Ionisation ("ASGDI") ion source; and (xx) a Glow Discharge ("GD") ion source.

The mass spectrometer preferably further comprises one or more continuous or pulsed ion sources. The mass spectrometer preferably further comprises one or more ion guides arranged upstream and/or downstream of the Electron Transfer Dissociation or Proton Transfer Reaction device. The mass spectrometer preferably further comprises one or more ion mobility separation devices and/or one or more Field Asymmetric ion Mobility Spectrometer devices arranged upstream and/or downstream of the Electron Transfer Dissociation or Proton Transfer Reaction device.

The mass spectrometer preferably further comprises one or more ion traps or one or more ion trapping regions arranged upstream and/or downstream of the Electron Transfer Dissociation or Proton Transfer Reaction device. The mass spectrometer preferably further comprises one or more collision, fragmentation or reaction cells arranged upstream and/or downstream of the Electron Transfer Dissociation or Proton Transfer Reaction device, wherein the one or more collision, fragmentation or reaction cells are selected from the group consisting of (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation de ice (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device (xxiii) an ion-ion reaction device for reacting ions to form adduct or product ions; (xxiv) an ion-molecule reaction device for reacting ions to form adduct or product ions; (xxv) an ion-atom reaction device for reacting ions to form, adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer preferably further comprises a mass analyser selected from the group consisting of (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser. The mass spectrometer preferably further comprises one or more energy analysers or electrostatic energy analysers arranged upstream and/or downstream of the Electron Transfer Dissociation or Proton Transfer Reaction device. The mass spectrometer preferably further comprises one or more ion detectors arranged upstream and/or downstream of the Electron Transfer Dissociation or Proton Transfer Reaction device.

The mass spectrometer preferably further comprises one or more mass filters arranged upstream and/or downstream of the Electron Transfer Dissociation or Proton Transfer Reaction device, wherein the one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter. The mass spectrometer preferably further comprises a device or ion gate for pulsing ions into the Electron Transfer Dissociation or Proton Transfer Reaction device. The mass spectrometer preferably further comprises a device for converting a substantially continuous ion beam into a pulsed ion beam.

The mass spectrometer preferably further comprises: (a) one or more Atmospheric Pressure ion sources for generating analyte ions and/or reagent ions; and/or (b) one or more Electrospray ion sources for generating analyte ions and/or reagent ions; and/or (c) one or more Atmospheric Pressure Chemical ion sources for generating analyte ions and/or reagent ions; and/or (d) one or more Glow Discharge ion sources for generating analyte ions and/or reagent ions.

According to an embodiment one or more Glow Discharge ion sources may preferably provided in one or more vacuum chambers of the mass spectrometer.

The mass spectrometer may according to an embodiment further comprise: a C-trap; and an orbitrap mass analyser; wherein in a first mode of operation ions are transmitted to the C-trap and are then injected into the orbitrap mass analyser; and wherein in a second mode of operation ions are transmitted to the C-trap and then to a collision cell or Electron Transfer Dissociation and/or Proton Transfer Reaction device wherein at least some ions are fragmented into fragment ions, and wherein the fragment ions are then transmitted to the C-trap before being injected into the orbitrap mass analyser.

The mass spectrometer preferably further comprises a stacked ring ion guide comprising a plurality of electrodes having an aperture through which ions are transmitted in use and wherein the spacing of the electrodes increases along the length of the ion path. The apertures in the electrodes in an upstream section of the ion guide may have a first diameter and the apertures in the electrodes in a downstream section of the ion guide may have a second diameter which is smaller than the first diameter. Opposite phases of an AC or RE voltage are preferably applied to successive electrodes.

According to another aspect of the present invention there is provided a computer program executable by the control system of a mass spectrometer comprising an Electron Transfer Dissociation and/or Proton Transfer Reaction device comprising an ion guide comprising a plurality of electrodes and a control system, the computer program being arranged to cause the control system:

to estimate, determine or measure the degree to which at least some first ions are fragmented and/or reduced in charge due to Electron Transfer Dissociation and/or Proton Transfer Reaction as the first ions are transmitted through the ion guide and in response thereto to vary, alter, increase or decrease one or more parameters which affect the transmission and/or degree of fragmentation and/or degree of charge reduction of the first ions as the first ions pass through the ion guide.

According to another aspect of the present invention there is provided a computer readable medium comprising computer executable instructions stored on the computer readable medium, the instructions being arranged to be executable by a control system of a mass spectrometer comprising an Electron Transfer Dissociation and/or Proton Transfer Reaction device comprising an ion guide comprising a plurality of electrodes, the computer program being arranged to cause the control system:

to estimate, determine or measure the degree to which at least some first ions are fragmented and/or reduced in charge due to Electron Transfer Dissociation and/or Proton Transfer Reaction as the first ions are transmitted through the ion guide and in response thereto to vary, alter, increase or decrease one or more parameters which affect the transmission and/or degree of fragmentation and/or degree of charge reduction of the first ions as the first ions pass through the ion guide.

The computer readable medium is preferably selected from the group consisting of: (i) a ROM; (ii) an EAROM; (iii) an EPROM; (iv) an EEPROM; (v) a flash memory; and (vi) an optical disk.

According to another aspect of the present invention there is provided a method of mass spectrometry comprising:

providing an Electron Transfer Dissociation and/or Proton Transfer Reaction device comprising an ion guide comprising a plurality of electrodes; and estimating, determining or measuring the degree to which at least some first ions are fragmented and/or reduced in charge due to Electron Transfer Dissociation and/or Proton Transfer Reaction as the first ions are transmitted through the ion guide and in response thereto varying, altering, increasing or decreasing one or more parameters which affect the transmission and/or degree of fragmentation and/or degree of charge reduction of the first ions as the first ions pass through the ion guide.

According to another aspect of the present invention there is provided a mass spectrometer comprising:

an Electron Transfer Dissociation and/or Proton Transfer Reaction device comprising an ion guide comprising a plurality of electrodes; and a control system arranged and adapted:

(i) to determine the intensity or abundance I1 of one or more parent or precursor ions having a first charge state which emerge from the ion guide;

(ii) to determine the intensity or abundance I2 of one or more ions which emerge from the ion guide and which correspond with parent or precursor ions which have been charge reduced and which have a second charge state, wherein the second charge state is lower than the first charge state; and (iii) to vary the velocity and/or amplitude of one of more transient DC voltages which are applied to the electrodes in order to maintain the ratio I1/I2 or I2/I1 at a substantially constant value R with time.

According to another aspect of the present invention there is provided a mass spectrometer comprising:

an Electron Transfer Dissociation and/or Proton Transfer Reaction device comprising an ion guide comprising a plurality of electrodes; and a control system arranged and adapted:

(i) to determine the intensity or abundance I1 of one or more parent or precursor ions having a first charge state which emerge from the ion guide;

(ii) to determine the intensity or abundance I2 of one or more ions which emerge from the ion guide and which correspond with parent or precursor ions which have been fragmented; and (iii) to vary the velocity and/or amplitude of one of more transient DC voltages which are applied to the electrodes in order to maintain the ratio I1/I2 or I2/I1 at a substantially constant value R with time.

The value R is preferably selected from the group consisting of (i) <0.1; (v) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.1; (xxii) 2.1-2.2; (xxiii) 2.2-2.3; (xxiv) 2.3-2.4; (xx) 2.4-2.5; (xxvi) 2.5-2.6; (xxvii) 2.6-2.7; (xxviii) 2.7-2.8; (xxix) 2.8-2.9; (xxx) 2.9-3.0; (xxxi) 3.0-3.1; (xxxii) 3.1-3.2; (xxxiii) 3.2-3.3; (xxxiv) 3.3-3.4; (xxx) 3.4-3.5; (xxxvi) 3.5-3.6; (xxvii) 3.6-3.7; (xxxviii) 3.7-3.8; (xxxix) 3.8-3.9; (xi) 3.9-4.0; (xli) 4.0-4.1; (xiii) 4.1-4.2; (xliii) 4.2-4.3; (xliv) 4.3-4.4; (xlv) 4.4-4.5; (xlvi) 4.5-4.6; (xlvii) 4.6-4.7; (xlviii) 4.7-4.8; (xlix) 4.8-4.9; (l) 4.9-5.0; and (li) >5.0.

According to another aspect of the present invention there is provided a method of mass spectrometry comprising:

providing an Electron Transfer Dissociation and/or Proton Transfer Reaction device comprising an ion guide comprising a plurality of electrodes;

determining the intensity or abundance I1 of one or more parent or precursor ions having a first charge state which emerge from the ion guide;

determining the intensity or abundance I2 of one or more ions which emerge from the ion guide and which correspond with parent or precursor ions which have been charge reduced and which have a second charge state, wherein the second charge state is lower than the first charge state; and varying the velocity and/or amplitude of one of more transient DC voltages which are applied to the electrodes in order to maintain the ratio I1/I2 or I2/I1 at a substantially constant value R with time.

According to another aspect of the present invention there is provided a method of mass spectrometry comprising:

providing an Electron Transfer Dissociation and/or Proton Transfer Reaction device comprising an ion guide comprising a plurality of electrodes;

determining the intensity or abundance I1 of one or more parent or precursor ions having a first charge state which emerge from the ion guide;

determining the intensity or abundance I2 of one or more ions which emerge from the ion guide and which correspond with parent or precursor ions which have been fragmented; and varying the velocity and/or amplitude of one of more transient DC voltages which are applied to the electrodes in order to maintain the ratio I1/I2 or I2/I1 at a substantially constant value R with time.

The value R is selected from the group consisting of (i) <0.1; (ii) 0.1-0.2; (iii) 0.2-0.3; (iv) 0.3-0.4; (v) 0.4-0.5; (vi) 0.5-0.6; (vu) 0.6-0.7; (viii) 0.7-0.8; fix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.1; (xxii) 2.1-2.2; (xxiii) 2.2-2.3; (xx v) 2.3-2.4; (xxv) 2.4-2.5; (xxxi) 2.5-2.6; (xxvii) 2.6-2.7; (xxviii) 2.7-2.8; (xxix) 2.8-2.9; (xxx) 2.9-3.0; (xxxi) 3.0-3.1; (xxxii) 3.1-3.2; (xxxiii) 3.2-3.3; (xxxiv) 3.3-3.4; (xxxv) 3.4-3.5; (xxxvi) 3.5-3.6; (xxxvii) 3.6-3.7; (xxxviii) 3.7-3.8; (xxxix) 3.8-3.9; (xl) 3.9-4.0; (xli) 4.0-4.1; (xlii) 4.1-4.2; (xliii) 4.2-4.3; (xliv) 4.3-4.4; (xlv) 4.4-4.5; (xlvi) 4.5-4.6; (xlvii) 4.6-4.7; (xlviii) 4.7-4.8; (xlix) 4.8-4.9; (l) 4.9-5.0; and (li) >5.0.

First and second transient DC voltage or potentials or voltage or potential waveforms or travelling waves may be applied sequentially or simultaneously to the electrodes of the ion guide of the ETD or PTR device.

Embodiments are contemplated wherein different species of cations and/or reagent ions are input into the ETD or PTR device from opposite ends of the device.

According to an embodiment the ETD or PTR device may comprise two adjacent ion tunnel sections. The electrodes in the first ion tunnel section may have a first internal diameter and the electrodes in the second section may have a second different internal diameter (which according to an embodiment may be smaller or larger than the first internal diameter). The first and/or second ion tunnel sections may be inclined to or otherwise be arranged off-axis from the general central longitudinal axis of the mass spectrometer. This allows ions to be separated from neutral particles which will continue to move linearly through the vacuum chamber.

Other embodiments are contemplated wherein the same reagent ions or neutral reagent gas which are used to effect Electron Transfer Dissociation may also be used to effect Proton Transfer Reaction and vice versa.

According to an embodiment a dual mode ion source or a twin ion source may be provided. For example, according to an embodiment an Electrospray ion source may be used to generate positive analyte ions and an Atmospheric Pressure Chemical Ionisation ion source may be used to generate negative reagent ions. Embodiments are also contemplated wherein a single ion source such as an Electrospray ion source, an Atmospheric Pressure Chemical Ionisation ion source or a Glow Discharge ion source may be used to generate analyte and/or reagent ions.

At least some multiply charged analyte cations are preferably caused to interact with at least some reagent ions wherein at least some electrons are transferred from the reagent anions to at least some of the multiply charged analyte cations whereupon at least some of the multiply charged analyte cations are induced to dissociate to form product or fragment ions.

The preferred embodiment relates to an ion-ion reaction device and/or ion-neutral gas reaction device wherein one or more travelling wave or electrostatic fields are preferably applied to the electrodes of an RF ion guide. The RE ion guide preferably comprises a plurality of electrodes having apertures through which ions are transmitted in use. The one or more travelling wave or electrostatic fields preferably comprise one or more transient DC voltages or potentials or one or more transient DC voltage or potential waveforms which are preferably applied to the electrodes of the ion guide.

The preferred embodiment relates to an apparatus for mass spectrometry which is designed to spatially manipulate ions having opposing charges in order to facilitate and preferably maximise, optimise or minimise ion-ion reactions. In particular, the apparatus is preferably arranged and adapted to perform Electron Transfer Dissociation ("ETD") fragmentation and/or Proton Transfer Reaction ("PTR") charge state reduction of ions.

According to an embodiment negatively charged reagent ions (or neutral reagent gas) may be loaded into or otherwise provided or located in an ion-ion reaction or ion-neutral gas ETD or PTR device. Negatively charged reagent ions may, for example, be transmitted into an ion-ion ETD or PTR device by applying a DC travelling wave or one or more transient DC voltages or potentials to the electrodes forming the ion-ion reaction device.

Once the reagent anions (or neutral reagent gas) have been loaded into the ion-ion reaction device (or ion-neutral gas reaction device), multiply charged analyte cations may then preferably be driven or urged through or into the reaction de ice preferably by means of one or more subsequent or separate DC travelling waves. The one or more DC travelling waves are preferably applied to the electrodes of the reaction device. The reagent ions are preferably retained within the ion guide by applying a negative potential at one or both ends of the ion guide.

The one or more DC travelling waves preferably comprise one or more transient DC voltages or potentials or one or more transient DC voltage or potential waveforms which preferably cause ions to be translated or urged along at least a portion of the axial length of the ion guide. Ions are therefore effectively translated along the length of the ion guide by one or more real or DC potential barriers which are preferably applied sequentially to electrodes along the length of the ion guide, ion-ion reaction device or ion-neutral gas reaction device. As a result, positively charged analyte ions trapped between DC potential barriers are preferably translated along the length of the ion guide, ion-ion reaction device or ion-neutral gas reaction device and are preferably driven or urged through and into close proximity with negatively charged reagent ions (or neutral reagent gas) which is preferably already present in or within the ion guide or reaction device.

A particular advantage of this embodiment is that optimum conditions for ion-ion reactions and/or ion-neutral gas reactions are preferably achieved within the ion guide, ion-ion reaction device or ion-neutral gas reaction device. Furthermore, according to the preferred embodiment the optimum conditions can preferably be maintained by varying the speed, velocity or amplitude of the DC travelling wave. The kinetic energies of the reagent anions (or reagent gas) and the analyte cations can be closely matched. The residence time of product or fragment ions which result from the Electron Transfer Dissociation (or Proton Transfer Reaction) process can be carefully controlled so that the resulting fragment or product ions are not then duly neutralised.

The preferred embodiment of the present invention represents a significant improvement over conventional arrangements in the ability to carry out Electron Transfer Dissociation and/or Proton Transfer Reaction efficiently on mainstream (i.e. non-FTICR) commercial mass spectrometers whilst optimising the ETD fragmentation of analyte ions.

The speed and/or the amplitude of the one or more DC travelling waves which are preferably used to translate e.g. positively charged analyte ions through and/or along the ion guide, ion-ion reaction device or ion-neutral gas reaction device may be controlled in order to optimise the fragmentation of the analyte ions by Electron Transfer Dissociation and/or the charge state reduction of analyte ions by Proton Transfer Reaction. If positively charged fragment or product ions resulting from the Electron Transfer Dissociation (or Proton Transfer Reaction) process are allowed to remain for too long in the ion guide reaction device or ion-neutral gas reaction device after they have been formed, then they are likely to be neutralised. The preferred embodiment enables positively charged fragment or product ions to be removed or extracted from the ion guide, ion-ion reaction device or ion-neutral gas reaction device soon after they are formed within the ion guide, ion-ion reaction device or ion-neutral gas reaction.

According to the preferred embodiment a negative potential or potential barrier may optionally be applied at the front (e.g. upstream) end and also at the rear (e.g. downstream) end of the ion guide, ion-ion reaction device or ion-neutral gas reaction device or ETD or PTR device. The negative potential or potential barrier preferably acts to confine negatively charged reagent ions within the ion guide whilst at the same time allowing or causing positively charged product or fragment ions which are created within the ion guide, ion-ion reaction device or ion-neutral gas reaction device to emerge and exit from the ion guide, reaction device or ion-neutral gas reaction device in a relatively fast manner. Other embodiments are also contemplated wherein analyte ions may interact with neutral gas molecules and undergo Electron Transfer Dissociation and/or Proton Transfer Reaction. If neutral reagent gas is provided then a potential bather may or may not be provided.

Another embodiment is contemplated wherein a negative potential or potential bather is applied only to the front (e.g. upstream) end of the ion guide. A yet further embodiment is contemplated wherein a negative potential or potential bather is applied only to the rear (e.g. downstream) end of the ion guide. Other embodiments are contemplated wherein one or more negative potentials or potential barriers may be maintained at different positions along the length of the ion guide, ion-ion reaction device or ion-neutral gas reaction device. For example, one or more negative potentials or potential barriers may be provided at one or more intermediate positions along the length of the ion guide, ion-ion reaction device or ion-neutral gas reaction device.

According to a less preferred embodiment positive analyte ions may be retained within the ion guide by one or more positive potentials and then reagent ions or neutral reagent gas may be introduced into the ion guide.

According to an embodiment two electrostatic travelling waves or DC travelling waves may be applied to the electrodes of an ion guide, ion-ion reaction device or ion-neutral gas reaction device in a substantially simultaneous manner. The travelling wave electrostatic fields or transient DC voltage waveforms are preferably arranged to move or translate ions substantially simultaneously in opposite directions towards, for example, a central region of the ion guide, ion-ion reaction device or ion-neutral gas reaction device.

The ion guide, ion-ion reaction device or ion-neutral gas reaction device preferably comprises a plurality of stacked ring electrodes which are preferably supplied with an AC or RF voltage. The electrodes preferably comprise an aperture through which ions are transmitted in use. Ions are preferably confined radially within the ion guide, ion-ion reaction device or ion-neutral gas reaction device by applying opposite phases of the AC or RF voltage to adjacent electrodes so that a radial pseudo-potential barrier is preferably generated. The radial pseudo-potential barrier preferably causes ions to be confined radially along the central longitudinal axis of the ion guide, ion-ion reaction device or ion-neutral gas reaction device. The travelling waves or plurality of transient DC potentials or voltages which are preferably applied to the electrodes of the ion guide preferably cause cations and anions (or cations and cations, or anions and anions) to be directed towards one another so that favourable conditions for ion-ion reactions and/or ion-neutral gas reactions are preferably created in the middle (or another portion or region) of the ion guide, ion-ion reaction device or ion-neutral gas reaction device.

According to an embodiment two different analyte samples may be introduced from different ends of the ion guide. Additionally or alternatively, two different species of reagent ions may be introduced into the ion guide from different ends of the ion guide.

The ion guide, ion-ion reaction device or ion-neutral gas reaction device according to the preferred embodiment preferably does not suffer from the disadvantages associated with conventional Electron Transfer Dissociation arrangements since the travelling wave electrostatic field does not generate an axial mass to charge ratio dependent RF pseudo-potential barrier. Therefore, ions are not confined within the ion guide, ion-ion reaction device or ion-neutral gas reaction device in a mass to charge ratio dependent manner.

Another advantage of the preferred embodiment is that various parameters of the one or more DC travelling waves or transient DC potentials or voltages which are applied to the electrodes of the ion guide, ion-ion reaction device or ion-neutral gas reaction device can be controlled and optimised. For example, parameters such as the wave shape, wavelength, wave profile, wave speed and the amplitude of the one or more DC travelling voltage waves can be controlled and optimised. The preferred embodiment enables the spatial location of ions in the ion guide, ion-ion reaction device or ion-neutral gas reaction device to be controlled in a flexible manner irrespective of the mass to charge ratio or polarity of the ions within the ion guide, ion-ion reaction device or ion-neutral gas reaction device.

The DC travelling wave parameters (i.e. the parameters of the one or more transient DC voltages or potentials which are applied to the electrodes) can according to the preferred embodiment be optimised to provide control over the relative ion velocity between cations and anions (or analyte cations and neutral reagent gas) in an ion-ion reaction or ion-neutral gas region of the ion guide or reaction device. The relative ion velocity between cations and anions or cations and neutral reagent gas is an important parameter that preferably determines the reaction rate constant in Electron Transfer Dissociation and Protein Transfer Reaction experiments.

Other embodiments are also contemplated wherein the velocity of ion-neutral collisions can be increased using either a high speed travelling wave or by using a standing or static DC wave. Such collisions can also be used to promote Collision Induced Dissociation ("CID"). In particular, the product or fragment ions resulting from Electron Transfer Dissociation or Proton Transfer Reaction may form non-covalent bonds. These non-covalent bonds can then be broken by Collision Induced Dissociation. Collision Induced Dissociation may be performed either sequentially in space to the process of Electron Transfer Dissociation in a separate Collision induced Dissociation cell and/or sequentially in time to the Electron Transfer Dissociation process in the same ion-ion reaction or ion-neutral gas reaction device.

According to an embodiment of the present invention the process of Electron Transfer Dissociation may be followed (or preceded) by Proton Transfer Reaction in order to reduce the charge state of the multiply charged fragment or product ions (or the analyte ions).

According to an embodiment the reagent ions used for Electron Transfer Dissociation and reagent ions used for Proton Transfer Reaction may be generated from the same or different neutral compounds. Reagent and analyte ions may be generated by the same ion source or by two or more separate ion sources.

According to an embodiment of the present invention a new method of Data Directed Analysis ("DDA") is provided that incorporates real time monitoring of the ratio of the intensities of the charge reduced cations or charge reduced analyte ions to the intensity of non-charged reduced the parent cations within a product ion spectrum. The ratio is preferably used to control instrumental parameters that regulate the degree of Electron Transfer Dissociation and/or Proton Transfer Reaction. As a result the fragment ion efficiency may be maximised in real time and on timescales which are comparable with liquid chromatography (LC) peak elution time scales.

The preferred embodiment preferably provides real time feedback control of instrumental parameters that preferably maximize or alter the abundance of fragment and/or charge reduced ions based upon the ratio of the abundance of charge reduced analyte cations to parent analyte cations.

BRIEF DESCRIPTION OF THE DRAWINGS

Various embodiments of the present invention will now be described, by way of example only, and with reference to the accompanying drawings in which:

FIG. 5 shows the axial location as a function of time of two pairs of cations and anions having mass to charge ratios of 300 which were modelled as being initially provided at the ends of an ion guide, ion-ion reaction device or ion-neutral gas reaction device and wherein two opposing travelling DC voltage waveforms were modelled as being applied to the electrodes of the ion guide, ion-ion reaction device or ion-neutral gas reaction device so that ions were caused to converge in the central region of the ion guide, ion-ion reaction device or ion-neutral gas reaction device;

DETAILED DESCRIPTION OF THE PREFERRED EMBODIMENTS

Figure 1:
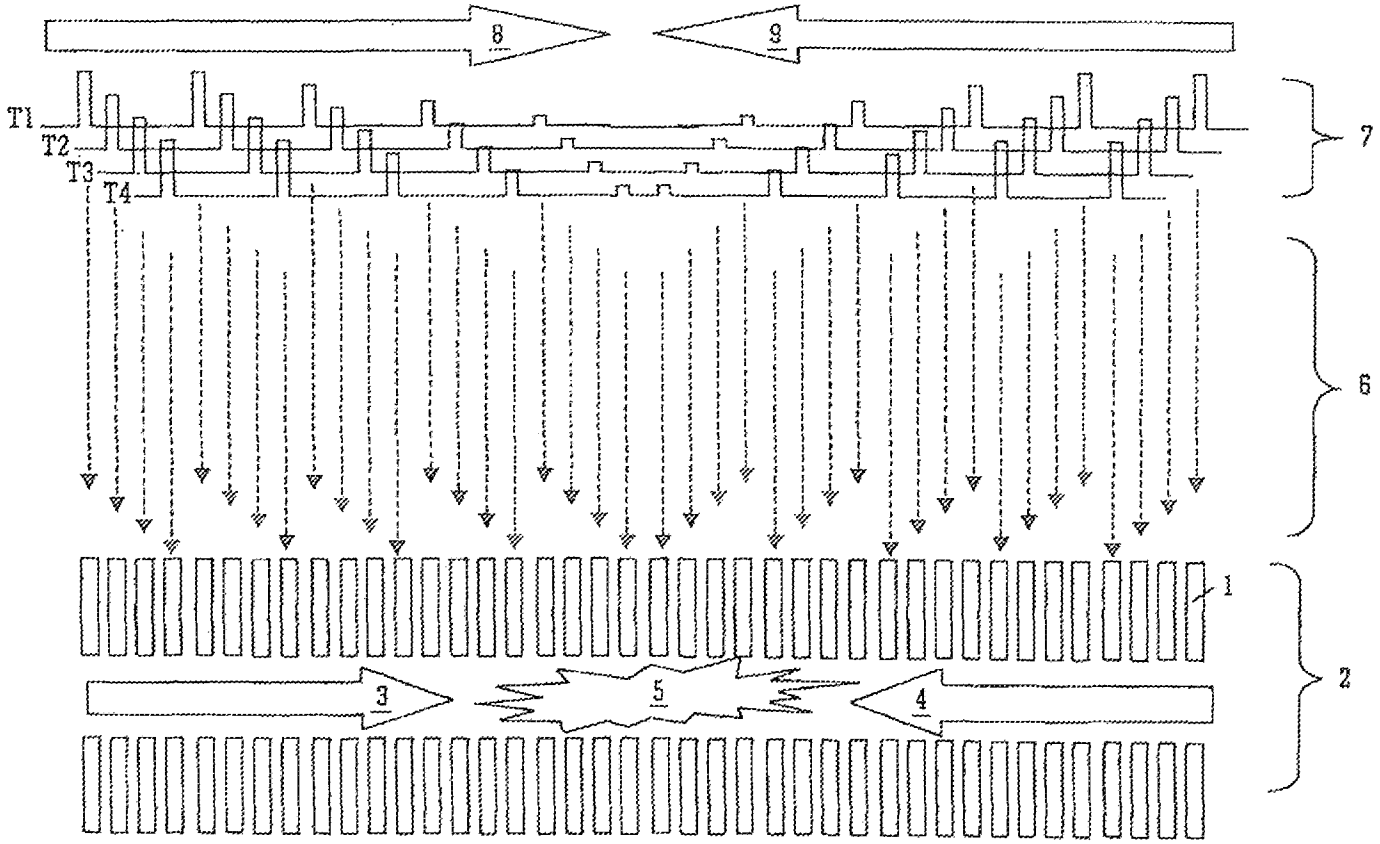
FIG. 1 shows two transient DC voltages or potentials being applied simultaneously to the electrodes of an ion guide, ion-ion reaction device or ion-neutral gas reaction device so that analyte cations and reagent anions are brought together in the central region of the ion guide, ion-ion reaction device or ion-neutral gas reaction device.

Various embodiments of the present invention will now be described. FIG. 1 shows a cross sectional view of the lens elements or ring electrodes 1 which together form a stacked ring ion guide, ion-ion reaction device or ion-neutral gas reaction device 2 according to a preferred embodiment of the present invention.

The ion guide, ion-ion reaction device or ion-neutral gas reaction device 2 preferably comprises a plurality of electrodes 1 having one or more apertures through which ions are transmitted in use. A pattern or series of digital voltage pulses 7 is preferably applied to the electrodes 1 in use. The digital voltage pulses 7 are preferably applied in a stepped sequential manner and are preferably sequentially applied to the electrodes 1 as indicated by arrows 6. According to an embodiment as illustrated in FIG. 1, a first DC unveiling wave 8 or series of transient DC voltages or potentials is preferably arranged to move in time from a first (upstream) end of the ion guide, ion-ion reaction device or ion-neutral gas reaction device 2 towards the middle of the ion guide, ion-ion reaction device or ion-neutral as reaction device 2. At the same time, a second DC travelling wave 9 or series of transient DC voltages or potentials may optionally be arranged to move in time from a second (downstream) end of the ion guide, ion-ion reaction device or ion-neutral gas reaction device 2 also towards the middle of the ion guide, ion-ion reaction device or ion-neutral gas reaction device 2. As a result, the two DC travelling waves 8,9 or series of transient DC voltages or potentials preferably converge from opposite sides of the ion guide, ion-ion reaction device or ion-neutral gas reaction device 2 towards the middle or central region of the ion guide, ion-ion reaction device or ion-neutral gas reaction device 2.

FIG. 1 shows digital voltage pulses 7 which are preferably applied to the electrodes 1 as a function of time (e.g. as an electronics timing clock progresses). The progressive nature of the application of the digital voltage pulses 7 to the electrodes 1 of the ion guide, ion-ion reaction device or ion-neutral gas reaction device 2 as a function of time is preferably indicated by arrows 6. At a first time T1, the voltage pulses indicated by T1 are preferably applied to the electrodes 1. At a subsequent time T2, the voltage pulses indicated by T2 are preferably applied to the electrodes 1. At a subsequent tune T3, the voltage pulses indicated by T3 are preferably applied to the electrodes 1. Finally, at a subsequent time 14, the voltage pulses indicated by T4 are preferably applied to the electrodes 1. The voltage pulses 7 preferably have a square wave electrical potential profiles as shown.

As is also apparent from FIG. 1, the intensity or amplitude of the digital pulses 7 applied to the electrodes 1 may be arranged to reduce towards the middle or centre of the ion guide, ion-ion reaction device or ion-neutral gas reaction device 2. As a result, the intensity or amplitude of the digital voltage pulses 7 which are preferably applied to electrodes 1 which are close to the input or exit regions or ends of the ion guide, ion-ion reaction device or ion-neutral gas reaction device 2 are preferably greater than the intensity or amplitude of the digital voltage pulses 7 which are preferably applied to electrodes 1 in the central region of the ion guide, ion-ion reaction device or ion-neutral gas reaction device 2. Other embodiments are contemplated wherein the amplitude of the transient DC voltages or potentials or the digital voltage pulses 7 which are preferably applied to the electrodes 1 does not reduce with axial displacement along the length of the ion guide, ion-ion reaction device or ion-neutral gas reaction device 2. According to this embodiment the amplitude of the digital voltages pulses 7 remains substantially constant with axial displacement along the length of the ion guide, ion-ion reaction device or ion-neutral gas reaction device 2.

The voltage pulses 7 which are preferably applied to the lens elements or ring electrodes 1 of the ion guide, ion-ion reaction device or ion-neutral gas reaction device 2 are preferably square waves. The electric potential within the ion guide, ion-ion reaction device or ion-neutral gas reaction device 2 preferably relaxes so that the wave function potential within the ion guide, ion-ion reaction device or ion-neutral gas reaction device 2 preferably takes on a smooth function.

Figure 2:
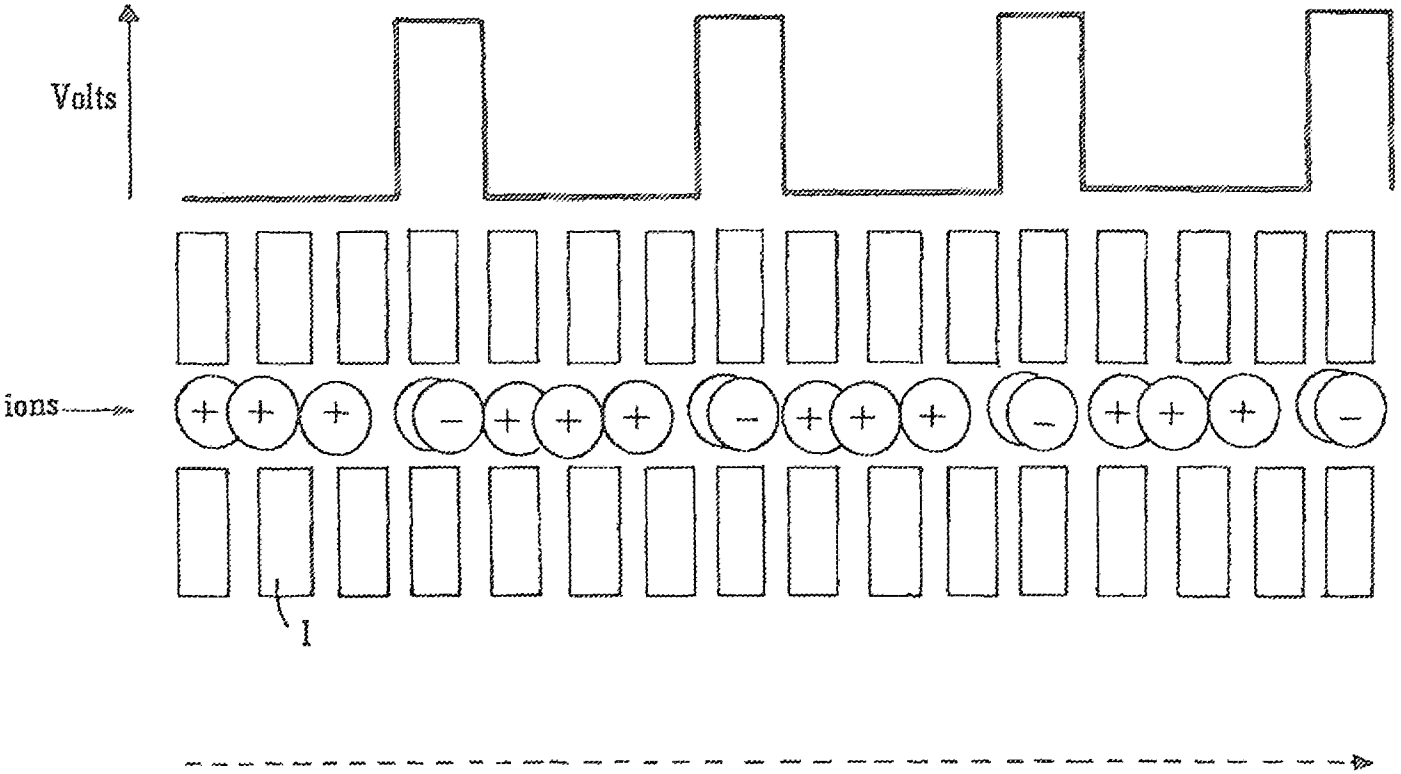
FIG. 2 illustrates how a travelling DC voltage waveform applied to the electrodes of an ion guide, ion-ion reaction device or ion-neutral gas reaction device can be used to translate simultaneously both positive and negative ions in the same direction.

According to an embodiment analyte cations (e.g. positively charged analyte ions) and/or reagent anions (e.g. negatively charged reagent ions) may be simultaneously introduced into the ion guide, ion-ion reaction device or ion-neutral gas reaction device 2 from opposite ends of the ion guide, ion-ion reaction device or ion-neutral gas reaction device 2. Once in the ion guide, ion-ion reaction device or ion-neutral gas reaction device 2, positive ions (cations) are preferably repelled by the positive (crest) potentials of the DC travelling wave or the one or more transient DC voltages or potentials which are preferably applied to the electrodes 1 of the ion guide, ion-ion reaction device or ion-neutral gas reaction device 2. As the electrostatic travelling wave moves along the length of the ion guide, ion-ion reaction device or ion-neutral gas reaction device 2, the positive ions are preferably pushed along the ion guide, ion-ion reaction device or ion-neutral gas reaction device 2 in the same direction as the travelling wave and in a manner substantially as shown in FIG. 2.

Negatively charged reagent ions i.e. reagent anions) will be attracted towards the positive potentials of the travelling wave and will likewise be drawn, urged or attracted in the direction of the travelling wave as the travelling DC voltages or potentials move along the length of the ion guide, ion-ion reaction device or ion-neutral gas reaction device 2. As a result, whilst positive ions will preferably travel in the negative crests (positive valleys) of the travelling DC wave, negative ions will preferably travel in the positive crests (negative valleys) of the travelling DC wave or the one or more transient DC voltages or potentials.

According to an embodiment two opposed travelling DC waves 8,9 may be arranged to translate ions substantially simultaneously towards the middle or centre of the ion guide, ion-ion reaction device or ion-neutral gas reaction device 2 from both ends of the ion guide, ion-ion reaction device or ion-neutral gas reaction device 2. The travelling DC waves 8,9 are preferably arranged to move towards each other and can be considered as effectively converging or coalescing in the central region of the ion guide, ion-ion reaction device or ion-neutral gas reaction device 2. Cations and anions are preferably simultaneously carried towards the middle of the ion guide, ion-ion reaction device or ion-neutral gas reaction device 2. Less preferred embodiments are contemplated wherein analyte cations may be simultaneously introduced from different ends of the reaction device. According to this embodiment the analyte ions may be reacted with neutral reagent gas present within the reaction device or which is added subsequently to the reaction device. According to another embodiment two different species of reagent ions may be introduced (simultaneously or sequentially) into the preferred reaction device from different ends of the reaction device.

According to an embodiment cations may be translated towards the centre of the ion guide, ion-ion reaction device or ion-neutral gas reaction device 2 by a first travelling DC wave 8 and anions may be translated towards the centre of the ion guide, ion-ion reaction device or ion-neutral gas reaction device 2 by a second different travelling DC wave 9.

However, other embodiments are contemplated wherein both cations and anions may be simultaneously translated by a first DC travelling wave 8 towards the centre (or other region) of the ion guide, ion-ion reaction device or ion-neutral gas reaction device 2. According to this embodiment cations and/or anions may also optionally be simultaneously translated towards the centre (or other region) of the ion guide, ion-ion reaction device or ion-neutral gas reaction device 2 by a second DC travelling voltage wave 9. So for example, according to an embodiment anions and cations may be simultaneously translated by a first DC travelling wave 8 in a first direction at the same time as other anions and cations are simultaneously translated by a second DC travelling wave 9 which preferably moves in a second direction which is preferably opposed to the first direction.

According to an embodiment as ions approach the middle or central region of the ion guide, ion-ion reaction device or ion-neutral gas reaction device 2, the propelling force of the travelling waves 8,9 may be programmed to diminish and the amplitude of the travelling waves in the central region of the ion guide, ion-ion reaction device or ion-neutral gas reaction device 2 may be arranged to become effectively zero or is otherwise at least significantly reduced. As a result, the valleys and peaks of the travelling waves preferably effectively disappear (or are otherwise significantly reduced) in the middle (Centre) of the ion guide, ion-ion reaction device or ion-neutral gas reaction device 2 so that according to an embodiment ions of opposite polarity (or less preferably of the same polarity) are then preferably allowed or caused to merge and interact with each other within the central region of the ion guide, ion-ion reaction device or ion-neutral gas reaction device 2. If any ions stray randomly axially away from the middle or central region of the ion guide, ion-ion reaction device or ion-neutral gas reaction device 2 due, for example, to multiple collisions with buffer gas molecules or due to high space charge effects, then these ions will then preferably encounter subsequent travelling DC waves which will preferably have the effect of translating or urging the ions back towards the centre of the ion guide, ion-ion reaction device or ion-neutral gas reaction device 2.

According to an embodiment positive analyte ions may be arranged to be translated towards the centre of the ion guide, ion-ion reaction device or ion-neutral gas reaction device 2 by a first DC travelling wave 8 which is arranged to move in a first direction and negative reagent ions may be arranged to be translated towards the centre of the ion guide, ion-ion reaction device or ion-neutral gas reaction device 2 by a second DC travelling wave 9 which is arranged to move in a second direction which is opposed to the first direction.

According to other embodiments instead of applying two opposed DC travelling waves 8,9 to the electrodes 1 of the ion guide, ion-ion reaction device or ion-neutral gas reaction device 2 a single DC travelling wave may instead be applied to the electrodes 1 of the ion guide, ion-ion reaction device or ion-neutral gas reaction device 2 at any particular instance in time. According to this embodiment negatively charged reagent ions (or less preferably positively charged analyte ions) may first be loaded or directed into the ion guide, ion-ion reaction device or ion-neutral gas reaction device 2. The reagent anions are preferably translated from an entrance region of the ion guide, ion-ion reaction device or ion-neutral gas reaction device 2 along and through the ion guide, ion-ion reaction device or ion-neutral gas reaction device by a DC travelling wave. The reagent anions may be retained within the ion guide, ion-ion reaction device or ion-neutral gas reaction device 2 by applying a negative potential at the opposite end or exit end of the ion guide, ion-ion reaction device or ion-neutral gas reaction device 2.

After reagent anions (or less preferably analyte cations) have been loaded into the ion guide, ion-ion reaction device or ion-neutral gas reaction device 2, positively charged analyte ions (or less preferably negatively charged reagent ions) are then preferably translated along and through the ion guide, ion-ion reaction device or ion-neutral gas reaction device 2 by a DC travelling wave or a plurality of transient DC voltages or potentials applied to the electrodes 1.

The DC travelling wave which translates the reagent anions and the analyte cations preferably comprises one or more transient DC voltage or potentials or one or more transient DC voltage or potential waveforms which are preferably applied to the electrodes 1 of the ion guide, ion-ion reaction device or ion-neutral gas reaction device 2. The parameters of the DC travelling wave and in particular the speed or velocity at which the transient DC voltages or potentials are applied to the electrodes 1 along the length of the ion guide, ion-ion reaction device or ion-neutral gas reaction device 2 may be varied or controlled in order to optimise, maximise or minimise ion-ion reactions between the negatively charged reagent ions and the positively charged analyte ions.

Fragment or product ions which result from the ion-ion interactions are preferably swept out of the ion guide, ion-ion reaction device or ion-neutral gas reaction device 2, preferably by a DC travelling wave and preferably before the fragment or product ions can be neutralised. Unreacted analyte ions and/or unreacted reagent ions may also be removed from the ion guide, ion-ion reaction device or ion-neutral gas reaction device 2, preferably by a DC travelling wave, if so desired. The negative potential which is preferably applied across at least the downstream end of the ion guide, ion-ion reaction device or ion-neutral gas reaction device 2 will preferably also act to accelerate positively charged product or fragment anions out of the ion guide, ion-ion reaction device or ion-neutral gas reaction device 2.

According to an embodiment a negative potential may optionally be applied to one or both ends of the ion guide, ion-ion reaction device or ion-neutral gas reaction device 2 in order to retain negatively charged ions within the ion guide, ion-ion reaction device or ion-neutral gas reaction device 2. The negative potential which is applied preferably also has the effect of encouraging or urging positively charged fragment or product ions which are created or formed within the ion guide, ion-ion reaction device or ion-neutral gas reaction device 2 to exit the ion guide, ion-ion reaction device or ion-neutral gas reaction device 2 via one or both ends of the ion guide, ion-ion reaction device or ion-neutral gas reaction device 2.

According to an embodiment positively charged fragment or product ions may be arranged to exit the ion guide, ion-ion reaction device or ion-neutral gas reaction device 2 after approximately 30 ms from formation thereby avoiding neutralisation of the positively charged fragment or product ions within the ion guide, ion-ion reaction device or ion-neutral gas reaction device 2. However, other embodiments are contemplated wherein the fragment or product ions formed within the ion guide, ion-ion reaction device or ion-neutral gas reaction device 2 may be arranged to exit the ion guide, ion-ion reaction device or ion-neutral gas reaction device 2 more quickly e.g. within a timescale of 0-10 ms, 10-20 ms or 20-30 ins. Alternatively, the fragment or product ions formed within the ion guide, ion-ion reaction device or ion-neutral gas reaction device 2 may be arranged to exit the ion guide, ion-ion reaction device or ion-neutral gas reaction device 2 more slowly e.g. within a timescale of 30-40 ms, 40-50 ms, 50-60 ms, 60-70 ms, 70-80 ms, 80-90 ms, 90-100 ms or >100 ms.

Figure 3:
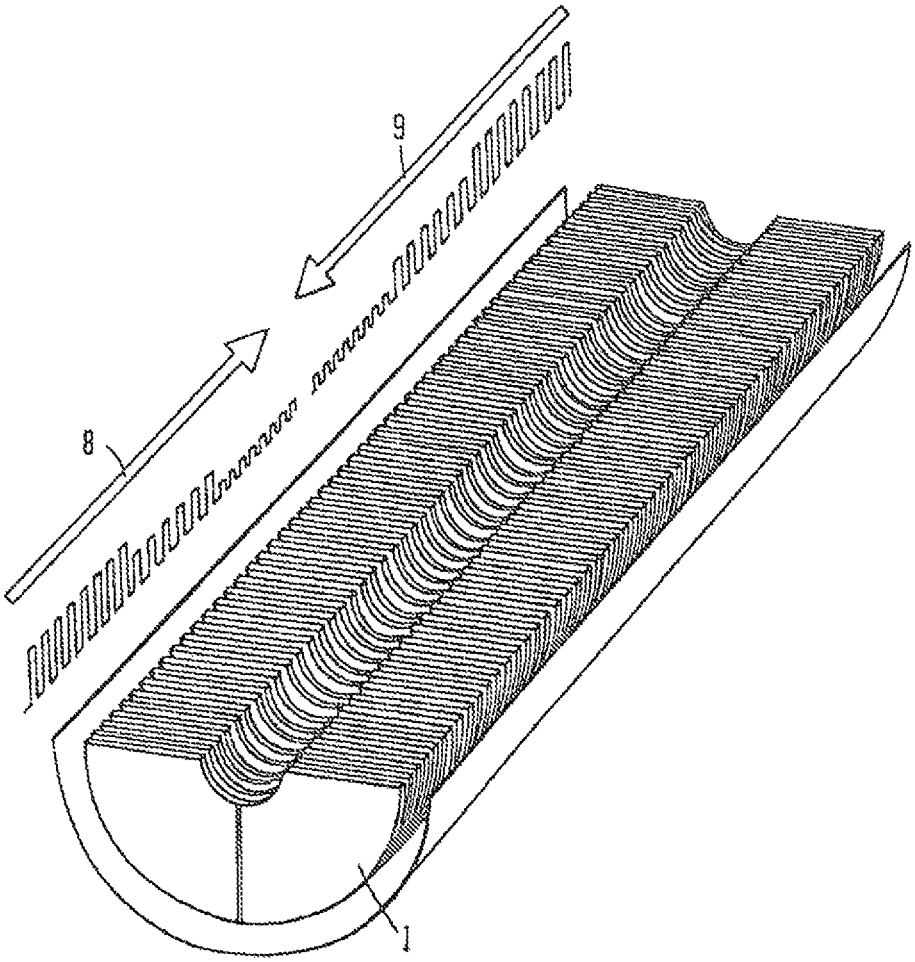
FIG. 3 shows a cross-sectional view of a SIMION® simulation of an ion guide, ion-ion reaction device or ion-neutral gas reaction device according to an embodiment of the present invention wherein two travelling DC voltage waveforms are applied simultaneously to the electrodes of the ion guide, ion-ion reaction device or ion-neutral gas reaction device and wherein the amplitude of the travelling DC voltage waveforms progressively reduces towards the centre of the ion guide, ion-ion reaction device or ion-neutral gas reaction device.

Ion motion within and through a preferred ion guide, ion-ion reaction device or ion-neutral gas reaction device 2 has been modelled using SIMION 8®. FIG. 3 shows a cross sectional view through a series of ring electrodes 1 forming an ion guide, ion-ion reaction device or ion-neutral gas reaction device 2. Ion motion through an ion guide, ion-ion reaction device or ion-neutral gas reaction device 2 as shown in FIG. 3 was modelled using SIMION 8®. FIG. 3 also shows two converging DC travelling wave voltages 8,9 or series of transient DC voltages 8,9 which were modelled as being progressively applied to the electrodes 1 forming the ion guide, ion-ion reaction device or ion-neutral gas reaction device 2 according to an embodiment of the present invention. The DC travelling wave voltages 8,9 were modelled as converging towards the centre of the ion guide, ion-ion reaction device or ion-neutral gas reaction device 2 and had the effect of simultaneously translating ions from both ends of the ion guide, ion-ion reaction device or ion-neutral gas reaction device 2 towards the centre of the ion guide) ion-ion reaction device or ion-neutral gas reaction device 2.

Figure 4:
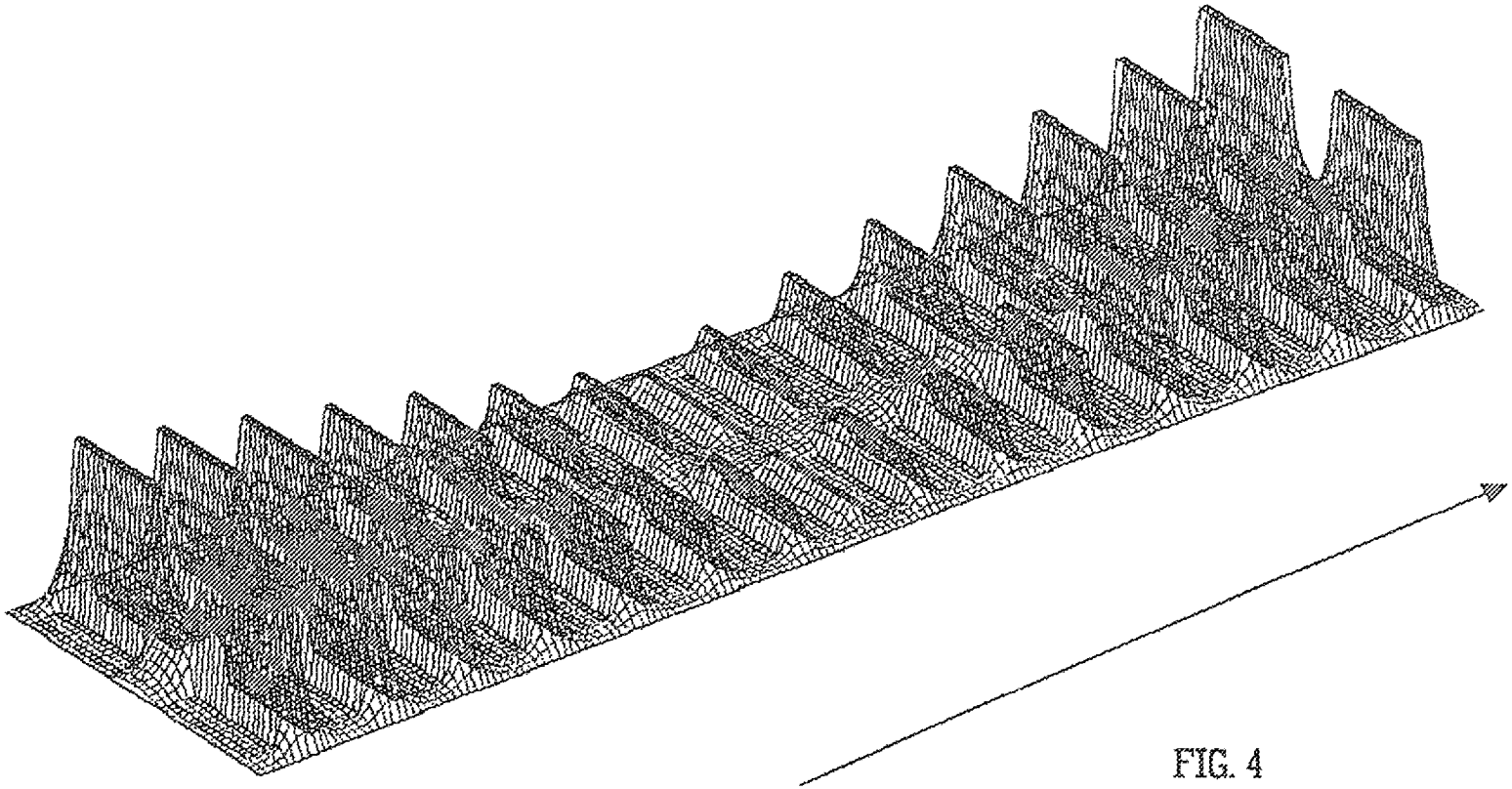
FIG. 4 shows a snap-shot of a potential energy surface within a preferred ion guide, ion-ion reaction device or ion-neutral gas reaction device when two opposing travelling DC voltage waveforms are modelled as being applied to the electrodes of the ion guide, ion-ion reaction device or ion-neutral gas reaction device and wherein the amplitude of the travelling DC voltage waveforms progressively reduces towards the centre of the ion guide, ion-ion reaction device or ion-neutral gas reaction device.
Figure 6A:
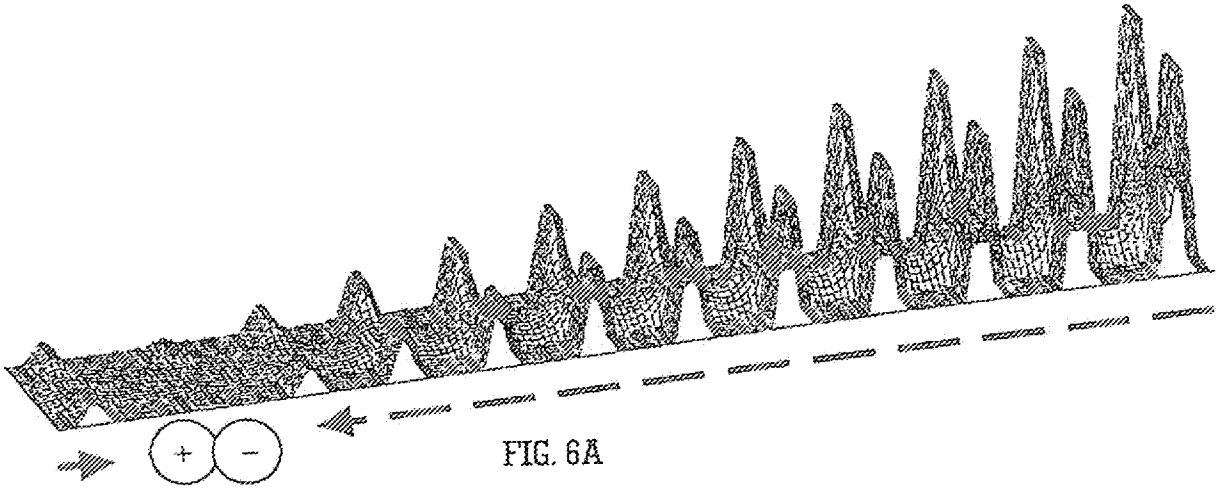
FIGS. 6A, 6B, 6C and 6D show a SIMION® simulation illustrating the potential energy within a preferred ion guide, ion-ion reaction device or ion-neutral gas reaction device according to an embodiment wherein the focal point or ion-ion reaction region is arranged to move progressively along the length of the ion guide, ion-ion reaction device or ion-neutral gas reaction device rather than remain fixed in the central region of the ion guide, ion-ion reaction device or ion-neutral gas reaction device.
Figure 6B:
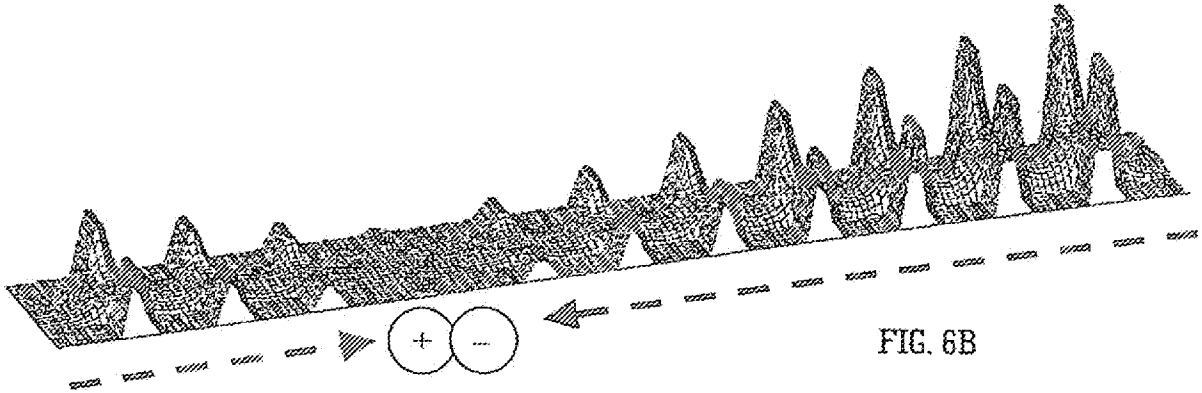
Figure 6C:
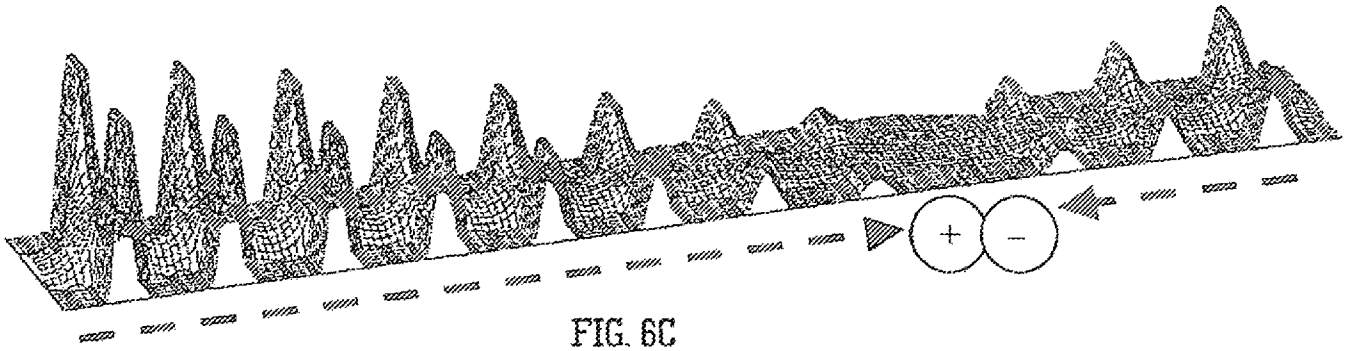
Figure 6D:
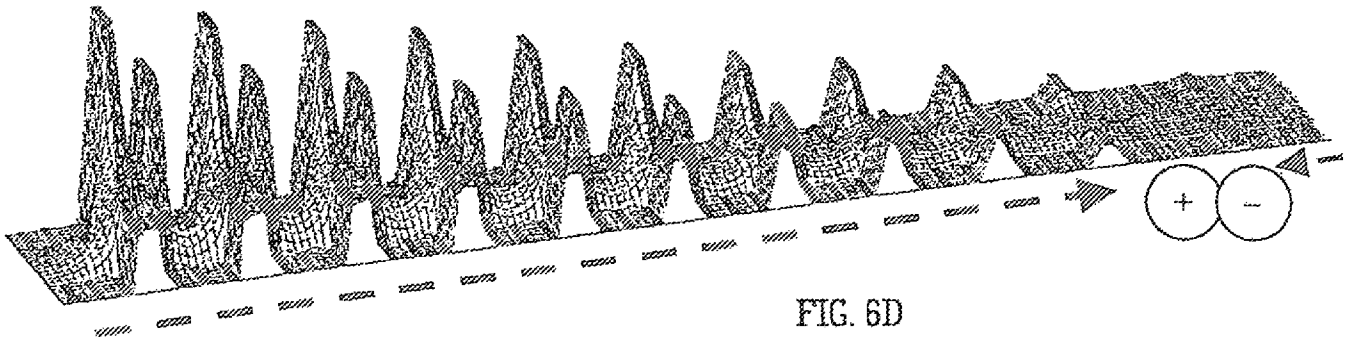

FIG. 4 shows a snap-shot of the potential energy surface within the ion guide, ion-ion reaction device or ion-neutral gas reaction device 2 at a particular instance in time as modelled by SIMION®.

FIG. 5 shows the result of a simulation wherein a first cation and anion pair where modelled as initially being provided at the upstream end of the ion guide, ion-ion reaction device or ion-neutral gas reaction device 2 and a second cation and anion pair were modelled as initially being provided at the downstream end of the ion guide, ion-ion reaction device or ion-neutral gas reaction device. Two DC travelling voltages waves were modelled as being applied simultaneously to the electrodes 1 of the ion guide, ion-ion reaction device or ion-neutral gas reaction device 2. One DC travelling voltage wave or series of transient DC voltages was modelled as being arranged to translate ions from the front or upstream end of the ion guide, ion-ion reaction device or ion-neutral gas reaction device 2 to the centre of the ion guide, ion-ion reaction device or ion-neutral gas reaction device 2 whilst the other DC travelling voltage wave or series of transient DC voltages was modelled as being arranged to translate ions from the rear or downstream end of the ion guide, ion-ion reaction device or ion-neutral gas reaction device 2 to the centre of the ion guide, ion-ion reaction device or ion-neutral gas reaction device 2.

FIG. 5 shows the subsequent axial location of the two pairs of cations and anions as a function of time. All four ions were modelled as having a mass to charge ratio of 300, it is apparent from FIG. 5 that both pairs of ions move towards the centre or middle region of the axial length of the ion guide, ion-ion reaction device or ion-neutral gas reaction device 2 (which is located at a displacement of 45 mm) after approximately 200 μs.

The ion guide, ion-ion reaction device or ion-neutral gas reaction device 2 was modelled as comprising a plurality of stacked conductive circular ring electrodes 1 made from stainless steel. The ring electrodes were arranged to have a pitch of 1.5 ram, a thickness of 0.5 mm and a central aperture diameter of 5 mm. The travelling wave profile was modelled as advancing at 5 us intervals so that the equivalent wave velocity towards the middle or centre of the ion guide, ion-ion reaction device or ion-neutral gas reaction device 2 was modelled as being 300 m/s. Argon buffer gas was modelled as being provided within the ion guide, ion-ion reaction device or ion-neutral gas reaction device 2 at a pressure of 0.076 Torr (i.e. 0.1 mbar). The length of the ion guide, ion-ion reaction device or ion-neutral gas reaction device 2 was modelled as being 90 mm. The typical amplitude of the voltage pulses was modelled as being 10 V. Opposing phases of a 100V RF voltage were modelled as being applied to adjacent electrodes 1 forming the ion guide, ion-ion reaction device or ion-neutral gas reaction device 2 so that ions were confined radially within the ion guide, ion-ion reaction device or ion-neutral gas reaction device 2 within a radial pseudo-potential valley.

It will be apparent from FIG. 5 that within the central region of the ion guide, ion-ion reaction device or ion-neutral gas reaction device 2 ions having opposing polarities will be located together in close proximity and at relatively low and substantially equal kinetic energies. An ion-ion reaction region is therefore, preferably provided or created within the central region of the ion guide, ion-ion reaction device or ion-neutral gas reaction device 2. Furthermore, the conditions for ion-ion interactions are substantially optimised.

The location or site of ion-ion reactions within the ion guide, ion-ion reaction device or ion-neutral gas reaction device 2 may be referred to as being a focal point of the ion guide, ion-ion reaction device or ion-neutral gas reaction device 2 in the sense that the focal point of the ion guide, ion-ion reaction device or ion-neutral gas reaction device 2 can be considered as being the place where reagent anions and analyte cations come into close proximity with one another and hence can interact with one another. Opposing DC travelling waves 8,9 may according to one embodiment be arranged to meet at the focal point or reaction volume. The amplitude of the DC travelling voltage waves 8,9 or transient DC voltages or potentials may be arranged to decay to substantially zero amplitude at the focal point or reaction volume.

As soon as any ion-ion reactions (or ion-neutral gas reactions) have occurred, any resulting product or fragment ions may be arranged to be swept out or otherwise translated away from the reaction volume of the ion guide, ion-ion reaction device or ion-neutral gas reaction device 2 preferably relatively quickly. According to one embodiment the resulting product or fragment ions are preferably caused to exit the ion guide, ion-ion reaction device or ion-neutral gas reaction device 2 and may then be onwardly transmitted to a mass analyser such as a Time of Flight mass analyser or an ion detector.

Product or fragment ions formed within the ion guide, ion-ion reaction device or ion-neutral gas reaction device 2 may be extracted in various ways. In relation to embodiments wherein two opposed DC travelling voltage waves 8,9 are applied to the electrodes 1 of the ion guide, ion-ion reaction device or ion-neutral gas reaction device, the direction of travel of the DC travelling wave 9 applied to the downstream region or exit region of the ion guide, ion-ion reaction device or ion-neutral gas reaction device 2 may be reversed. The DC travelling wave amplitude may also be normalised along the length of the ion guide, ion-ion reaction device or ion-neutral gas reaction device 2 so that the ion guide, ion-ion reaction device or ion-neutral gas reaction device 2 is then effectively operated as a conventional travelling wave ion guide i.e. a single constant amplitude DC travelling voltage wave moving in a single direction is applied across substantially the whole of the ion guide, ion-ion reaction device or ion-neutral gas reaction device 2.

Similarly, in relation to embodiments wherein a single DC travelling voltage wave initially loads reagent anions into the ion guide, ion-ion reaction device or ion-neutral gas reaction device 2 and then analyte cations are subsequently loaded into or transmitted through the ion guide, ion-ion reaction device or ion-neutral gas reaction device 2 by the same DC travelling voltage wave, then the single DC travelling voltage wave will also act to extract positively charged fragment or product ions which are created within the ion guide, ion-ion reaction device or ion-neutral gas reaction device 2. The DC travelling voltage wave amplitude may be normalised along the length of the ion guide, ion-ion reaction device or ion-neutral gas reaction device 2 once fragment or product ions have been created so that the ion guide, ion-ion reaction device or ion-neutral gas reaction device 2 is effectively operated as a conventional travelling wave ion guide.

It has been shown that if ions are translated by a travelling wave field through an ion guide which is maintained at a sufficiently high pressure (e.g. >0.1 mbar) then the ions may emerge from the end of the travelling wave ion guide in order of their ion mobility. Ions having relatively high ion mobilities will preferably emerge from the ion guide prior to ions having relatively low ion mobilities. Therefore, further analytical benefits such as improved sensitivity and duty cycle can be provided according to embodiments of the present invention by exploiting ion mobility separations of the product or fragment ions that are generated in the central region of the ion guide, ion-ion reaction device or ion-neutral gas reaction device 2.

According to an embodiment an ion mobility spectrometer or separation stage may be provided upstream and/or downstream of the ETD or PTR device, ion guide, ion-ion reaction device or ion-neutral gas reaction device 2. For example, according to an embodiment product or fragment ions which have been formed within the ETD or PTR device, ion guide, ion-ion reaction device or ion-neutral gas reaction device 2 and which have been subsequently extracted from the ETD or PTR device, ion guide, ion-ion reaction device or ion-neutral gas reaction device 2 may then be separated according to their ion mobility (or less preferably according to their rate of change of ion mobility with electric field strength) in an ion mobility spectrometer or separator which is preferably arranged downstream of the ETD or PTR device, ion guide, ion-ion reaction device or ion-neutral gas reaction device 2.

According to an embodiment the diameters of the internal apertures of the ring electrodes 1 forming the ETD or PTR device, ion guide, ion-ion reaction device or ion-neutral gas reaction device 2 may be arranged to increase progressively with electrode position along the length of the ETD or PTR device, ion guide, ion-ion reaction device or ion-neutral gas reaction device 2. The aperture diameters may be arranged, for example, to be smaller at the entry and exit sections of the ETD or PTR device, ion guide, ion-ion reaction device or ion-neutral gas reaction device 2 and to be relatively larger nearer the centre or middle of the ETD or PTR device, ion guide, ion-ion reaction device or ion-neutral gas reaction device 2. This will have the effect of reducing the amplitude of the DC potential experienced by ions within the central region of the ion guide, ion-ion reaction device or ion-neutral gas reaction device 2 whilst the amplitude of the DC voltages applied to the various electrodes 1 can be kept substantially constant. The travelling wave ion guide potential will therefore be at a minimum in the middle or central region of the ETD or PTR device, ion guide, ion-ion reaction device or ion-neutral gas reaction device 2 according to this embodiment.

According to another embodiment both the ring aperture diameter as well as the amplitude of the transient DC voltages or potentials applied to the electrodes 1 may be varied along the length of the ETD or PTR device, ion guide, ion-ion reaction device or ion-neutral gas reaction device 2.

In embodiments wherein the diameter of the aperture of the ring electrodes increases towards the centre of the ETD or PTR device, ion guide, ion-ion reaction device or ion-neutral gas reaction device 2, the RF field near the central axis will also decrease. Advantageously, this will give rise to less RF heating of ions in the central region of the ion guide, ion-ion reaction device or ion-neutral gas reaction device 2. This effect can be particularly beneficial in optimising Electron Transfer Dissociation type reactions and minimising collision induced reactions.

According to a further embodiment the position of the focal point or reaction region within the ETD or PTR device, ion guide, ion-ion reaction device or ion-neutral gas reaction device 2 may be moved or varied axially along the length of the ETD or PTR device, ion guide, ion-ion reaction device or ion-neutral gas reaction device 2 as a function of time. This has the advantage in that ions can be arranged to be flowing or passing continuously through the ETD or PTR device, ion guide, ion-ion reaction device or ion-neutral gas reaction device 2 without stopping in a central reaction region. This allows a continuous process of introducing analyte ions and reagent ions at the entrance of the ETD or PTR device, ion guide, ion-ion reaction device or ion-neutral gas reaction device 2 and ejecting product or fragment ions from the exit of the ETD or PTR device, ion guide, ion-ion reaction device or ion-neutral gas reaction device 2 to be achieved. Various parameters such as the speed of translation of the focal point may be varied or controlled in order to optimise, maximise or minimise the ion-ion reaction efficiency. The motion of the focal point can be achieved or controlled electronically in a stepwise fashion by switching or controlling the voltages applied to the appropriate lenses or ring electrodes 1.

The motion of ions within an ETD or PTR ion guide or ion-ion reaction region 2 wherein the focal point is varied with time has been investigated using SIMION®. FIGS. 6A-6D illustrate the potential energy surface within an ETD or PTR ion guide, ion-ion reaction device or ion-neutral gas reaction device 2 at different points in time according to an embodiment wherein the axial position of the focal point or reaction region varies with time. The dashed arrows depict the direction of opposed travelling wave DC voltages which are preferably applied to the electrodes 1 of the ETD or PTR ion guide, ion-ion reaction device or ion-neutral gas reaction device 2 according to an embodiment of the present invention. It can be seen from FIGS. 6A-6D that the intensity of the travelling DC wave voltages has been programmed to increase linearly with distance or displacement away from the focal point. However, various other amplitude functions for the travelling DC voltage waves may alternatively be used. It can also be seen that the motion of the reaction region or focal point can be programmed, for example, to progress from the entrance (i.e. left) of the ETD or PTR ion guide, ion-ion reaction device or ion-neutral gas reaction device 2 to the exit (i.e. right) of the ETD or PTR ion guide, ion-ion reaction device or ion-neutral gas reaction device 2. Therefore, the process of Electron Transfer Dissociation (and/or Proton Transfer Reaction) can be arranged to occur in a substantially continuous fashion as the focal point moves along or is translated along the length of the ion guide, ion-ion reaction device or ion-neutral gas reaction device 2. Eventually, product or fragment ions resulting from the Electron Transfer Dissociation reaction are preferably arranged to emerge from the exit of the ETD or PTR ion guide, ion-ion reaction device or ion-neutral gas reaction device 2 and may be onwardly transmitted, for example, to a Time of Flight mass analyser. To enhance the overall sensitivity of the system, the timing of the release of ions from the ETD or PTR ion guide, ion-ion reaction device or ion-neutral gas reaction device 2 may be synchronised with the pusher electrode of an orthogonal acceleration Time of Flight mass analyser. Variations on this embodiment are also contemplated wherein multiple focal points may be provided along the length of the ion guide, ion-ion reaction device or ion-neutral gas reaction device 2 and wherein optionally some or all of the focal points are translated along the length of the ion guide, ion-ion reaction device or ion-neutral gas reaction device 2.

According to an embodiment analyte cations and reagent anions which are input into the preferred ETD or PTR device, ion guide, ion-ion reaction device or ion-neutral gas reaction device 2 may be generated from separate or distinct ion sources. In order to efficiently introduce both cations and anions from separate ion sources into an ETD or PTR device, ion guide, ion-ion reaction device or ion-neutral gas reaction device 2 according to the preferred embodiment a further ion guide may be provided upstream (and/or downstream) of the preferred ETD or PTR device, ion guide, ion-ion reaction device or ion-neutral gas reaction device 2. The further ion guide may be arranged to simultaneously and continuously receive and transfer ions of both polarities from separate ion sources at different locations and to direct both the analyte and reagent ions into the preferred ETD or PTR device, ion guide, ion-ion reaction device or ion-neutral gas reaction device 2.

Figure 7:
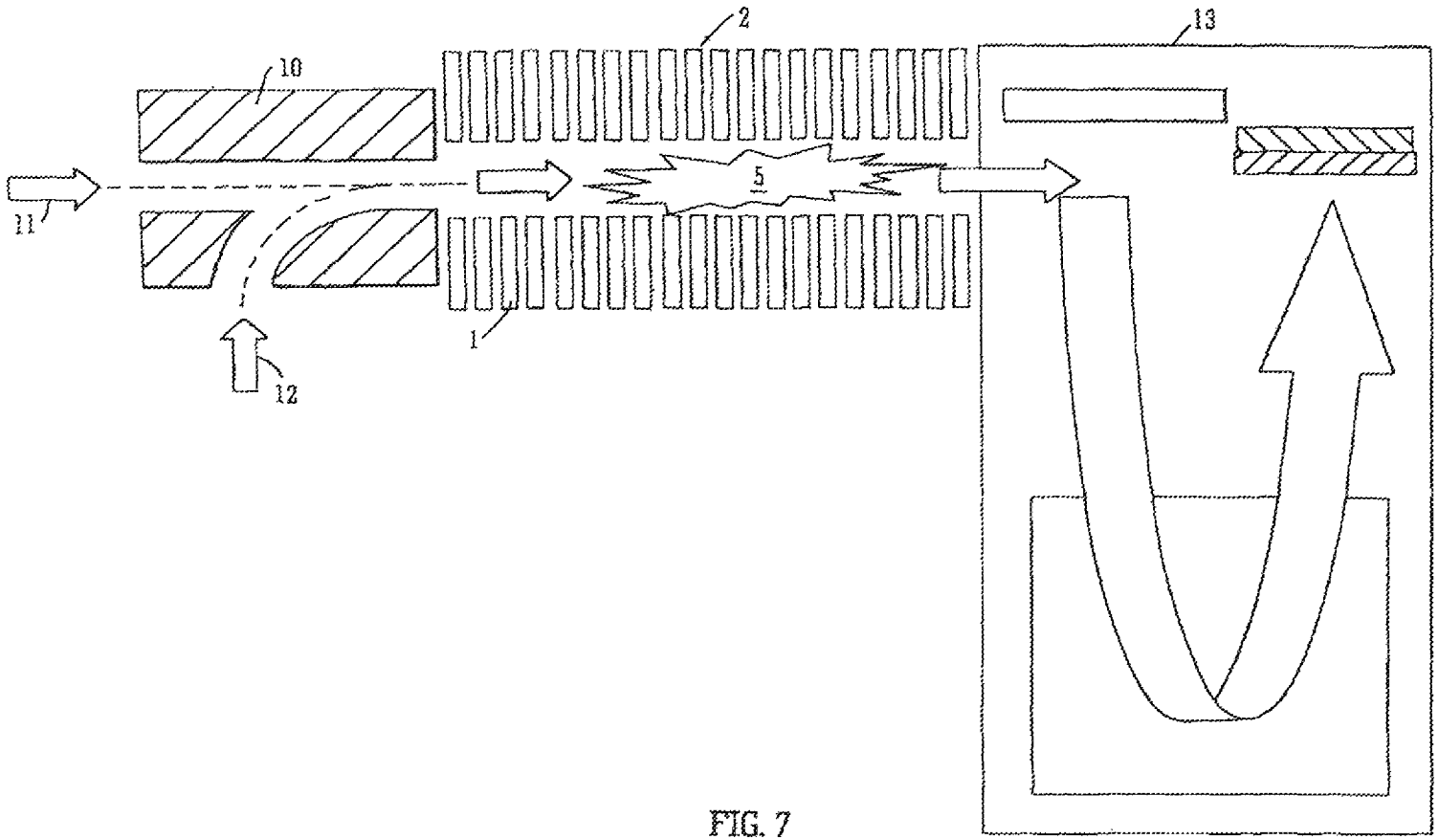
FIG. 7 shows an embodiment of the present invention wherein an ion guide coupler is provided upstream of a preferred ion guide, ion-ion reaction device or ion-neutral gas reaction device so that analyte and reagent ions can be directed into the preferred ion guide, ion-ion reaction device or ion-neutral gas reaction device and wherein the preferred ion guide, ion-ion reaction device or ion-neutral gas reaction device is coupled to an orthogonal acceleration Time of Flight mass analyser.

FIG. 7 illustrates an embodiment wherein an ion guide coupler 10 may be used to introduce both analyte cations 11 and reagent anions 12 into a preferred ETD or PTR device, ion guide, ion-ion reaction device or ion-neutral gas reaction device 2 in order to fonts product or fragment ions by Electron Transfer Dissociation in the ETD or PTR device, ion guide, ion-ion reaction device or ion-neutral gas reaction device 2. The ion guide coupler 10 may comprise a multiple plate RF ion guide such as is disclosed, for example, in U.S. Pat. No. 6,891,157. The ion guide coupler 10 may comprise a plurality of planar electrodes arranged generally in the plane of ion transmission. Adjacent planar electrodes are preferably maintained at opposite phases of an AC or RF potential. The planar electrodes are also preferably shaped so that ion guiding regions are formed within the ion guide coupler 10. Upper and/or lower planar electrodes may be provided and DC and/or RF voltages may be applied to the upper and/or lower planar electrodes in order to retain ions within the ion guide coupler 10.

One or more mass selective quadrupoles may also be utilized to select particular analyte and/or reagent ions received from the ion source(s) and to transmit only desired ions onwardly to the ion guide coupler 10. A Time of Flight mass analyser 13 may be arranged downstream of the preferred ion guide, ion-ion reaction device or ion-neutral gas reaction device 2 in order to receive and analyse product or fragment ions which are created in a reaction region 5 within the ion guide, ion-ion reaction device or ion-neutral gas reaction device 2 and which subsequently emerge from the ion guide, ion-ion reaction device or ion-neutral gas reaction device 2.

Experiments including applying travelling DC voltage waves to the electrodes of a stacked ring RF ion guide have shown that increasing the amplitude of the travelling DC wave voltage pulses and/or increasing the speed of the travelling DC wave voltage pulses within the ion reaction volume can, cause the ion-ion reaction rates to be reduced or even stopped when necessary. This is due to the fact that the travelling DC voltage wave can cause a localised increase in the relative velocity of analyte cations relative to reagent anions. The ion-ion reaction rate has been shown to be inversely proportional to the cube of the relative velocity between cations and anions.

Increasing the amplitude and/or the speed of the travelling DC voltage wave may also cause cations and anions to spend less time together in the ETD or PTR device, ion guide, ion-ion reaction device or ion-neutral gas reaction device 2 and hence may have the effect of reducing the reaction efficiency.

Figures 8A, 8B, 8C:
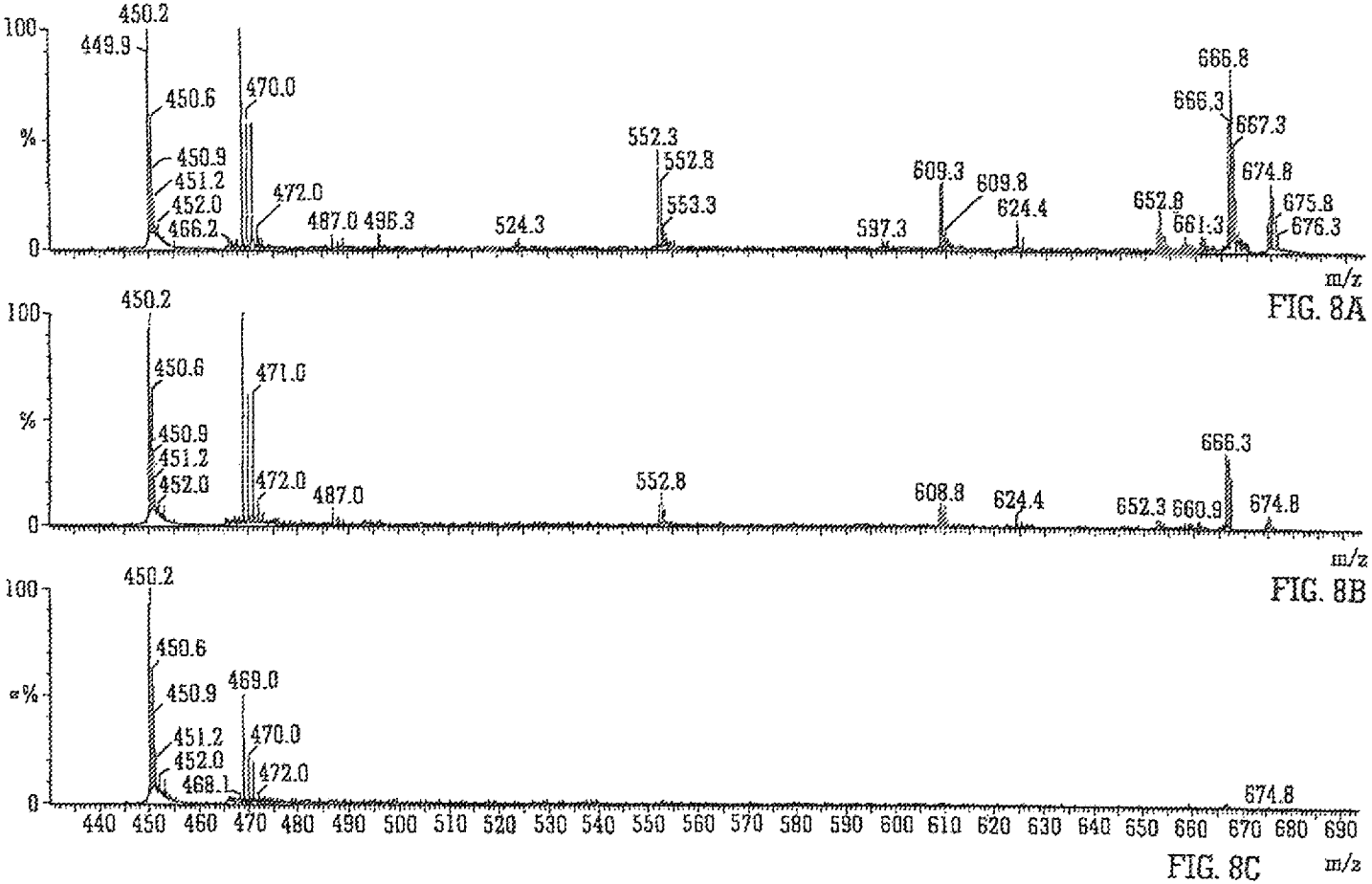
FIG. 8A shows a mass spectrum obtained when a travelling wave voltage having an amplitude of 0V was applied to the electrodes of a preferred ion guide, ion-ion reaction device or ion-neutral gas reaction device.
FIG. 8B shows a corresponding mass spectrum which was obtained when a travelling wave voltage having an amplitude of 0.5V was applied to the electrodes of the ion guide, ion-ion reaction device or ion-neutral gas reaction device.
FIG. 8C shows a mass spectrum obtained when the travelling wave voltage applied to the electrodes of the ion guide, ion-ion reaction device or ion-neutral gas reaction device was increased to 1V.

FIGS. 8A-8C illustrate the effect of varying the amplitude of the travelling DC voltage wave on the generation or formation of Electron Transfer Dissociation product or fragment ions generated within the gas cell of a hybrid quadrupole Time of Flight mass spectrometer. In particular, FIGS. 8A-8C show the Electron Transfer Dissociation product or fragment ions resulting from fragmenting triply charge precursor cations of substance-P having a mass to charge ratio of 449.9 following ion-ion reaction with azobenzene reagent anions. FIG. 8A shows a mass spectrum recorded when the travelling wave amplitude was set to 0 V, FIG. 8B shows a mass spectrum recorded when the travelling wave amplitude was set to 0.5 V and FIG. 8C shows a mass spectrum recorded when the travelling wave amplitude was increased to 1.0 V. It can be seen that the abundance of Electron Transfer Dissociation product or fragment ions is significantly reduced when a 1.0 V travelling wave is applied to the ion guide. This effect can be used to substantially prevent or quench the generation of Electron Transfer Dissociation fragment or product ions when so desired (and also to prevent or quench charge state reduction by Proton Transfer Reaction).

According to an embodiment of the present invention ion-ion reactions may be controlled, optimised, maximised or minimised by varying the amplitude and/or the speed of one or more DC travelling waves applied to the electrodes 1 of the ETD or PTR device, ion guide, ion-ion reaction device or ion-neutral gas reaction device 2. However, other embodiments are contemplated wherein instead of controlling the amplitude of the travelling DC wave fields electronically, the field amplitudes may be controlled mechanically by utilising stack ring electrodes that vary in internal diameter or axial spacing. If the aperture of the ring stack or ring electrodes 1 are arranged to increase in diameter then the travelling wave amplitude experienced by ions will decrease assuming that the same amplitude voltage is applied to all electrodes 1.

Embodiments are contemplated wherein the amplitude of the one or more travelling DC voltage waves may be increased further and wherein the travelling DC voltage wave velocity is then suddenly reduced to zero so that a standing wave is effectively created. According to this embodiment ions in the reaction volume may be repeatedly accelerated and then decelerated along the axis of the ETD or PTR device, ion guide ion-ion reaction device or ion-neutral gas reaction device 2. This approach can be used to cause an increase in the internal energy of product or fragment ions so that the product or fragment ions may further decompose by the process of Collision Induced Dissociation (CID). This method of Collision induced Dissociation is particularly useful in separating non-covalently bound product or fragment ions resulting from Electron Transfer Dissociation. Precursor ions that have previously been subjected to Electron Transfer Dissociation reactions often partially decompose (especially singly and doubly charged precursor ions) and the partially decomposed ions may remain non-covalently attached to each other.

According to another embodiment non-covalently bound product or fragment ions of interest may be separated from each other as they are being swept out from the stacked ring ion guide by the travelling DC wave operating in its normal mode of transporting ions. This may be achieved by setting the velocity of the travelling wave ion guide to a sufficiently high value such that ion-molecule collisions occur and induce the non-covalently bound fragment or product ions to separate.

Figure 9:
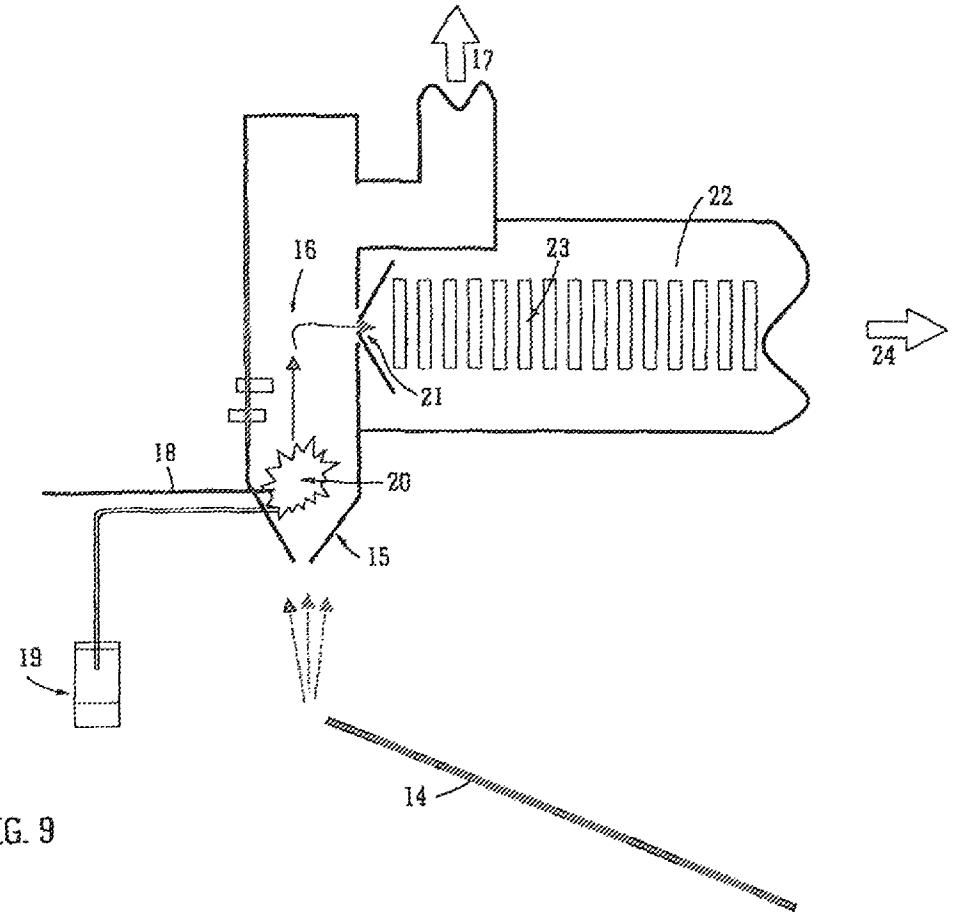
FIG. 9 shows an ion source section of a mass spectrometer according to an embodiment of the present invention wherein an Electrospray ion source is used to generate analyte ions and wherein reagent ions are generated in a glow discharge region located in an input vacuum chamber of the mass spectrometer.

According to another embodiment analyte ions and reagent ions may be generated either by the same ion source or by a common ion generating section or stage of a mass spectrometer. For example, according to an embodiment analyte ions may be generated by an Electrospray ion source and reagent ions may be generated in a glow discharge region which is preferably arranged downstream of the Electrospray ion source. FIG. 9 shows an embodiment of the present invention wherein analyte ions are produced by an Electrospray ion source. The capillary of the Electrospray ion source is preferably maintained at +3 kV. The analyte ions are preferably drawn towards a sample cone 15 of a mass spectrometer which is preferably maintained at 0V. Ions preferably pass through the sample cone 15 and into a vacuum chamber 16 which is preferably pumped by a vacuum pump 17. A glow discharge pin 18 which is preferably connected to a high voltage source is preferably located close to and downstream of the sample cone 15 within the vacuum chamber 16. The glow discharge pin 18 may according to one embodiment be maintained at −750V. Reagent from a reagent source 19 is preferably bled or otherwise fed into the vacuum chamber 16 at a location close to the glow discharge pin 18. As a result, reagent ions are preferably created within the vacuum chamber 16 in a glow discharge region 20. The reagent ions are then preferably drawn through an extraction cone 21 and pass into a further downstream vacuum chamber 22. An ion guide 23 is preferably located in the further vacuum chamber 22. The reagent ions are then preferably onwardly transmitted to further stages 24 of the mass spectrometer and are preferably transmitted to a preferred ETD or PTR device, ion guide, ion-ion reaction device or ion-neutral gas reaction device 2 which is preferably used as an Electron Transfer Dissociation and/or Proton Transfer Reaction device.

According to an embodiment of the present invention a dual mode or dual ion source may be provided. For example, according to an embodiment an Electrospray ion source may be used to generate analyte (or reagent) ions and an Atmospheric Pressure Chemical Ionisation ion source may be used to generate reagent (or analyte) ions. Negatively charged reagent ions may be passed into an ETD or PTR reaction device by means of one or more travelling DC voltages or transient DC voltages which are applied to the electrodes of the ETD or PTR reaction device. A negative DC potential may be applied to the ETD or PTR reaction device in order to retain the negatively charged reagent ions within the ETD or PTR reaction device. Positively charged analyte ions may then be input into the ETD or PTR reaction device by applying one or more travelling DC voltage or transient DC voltages to the electrodes of the ETD or PTR reaction device. The positively charged analyte ions are preferably not retained or prevented from exiting the ETD or PTR reaction device. The various parameters of the travelling DC voltage or transient DC voltages applied to the electrodes of the ETD or PTR reaction device may be optimised or controlled in order to optimise, maximise or minimise the degree of fragmentation by Electron Transfer Dissociation and/or charge state reduction of the analyte ions and/or product or fragment ions by Proton Transfer Reaction.

If a Glow Discharge ion source is used to generate reagent ions and/or analyte ions then the pin electrode of the ion source may, according to one embodiment, be maintained at a potential of ±500-700 V. According to an embodiment the potential of an ion source may be switched relatively rapidly between a positive potential (in order to generate cations) and a negative potential (in order to generate anions).

If a dual mode or dual ion source is provided, then it is contemplated that the ion source may be switched between modes or that the ion sources may be switched between each other approximately every 50 ms. Other embodiments are contemplated wherein the ion source may be switched between modes or the ion sources may be switched between each other on a timescale of <1 ms, 1-10 ms, 10-20 ms, 20-30 ms, 30-40 ms, 40-50 ms, 50-60 ms, 60-70 ms, 70-80 ms, 80-90 ms, 90-100 ms, 100-200 ms, 200-300 ms, 300-400 ms, 400-500 ms, 500-600 ms, 600-700 ms, 700-800 ms, 800-900 ms, 900-1000 ms, 1-2 s, 2-3 s, 3-4 s, 4-5 s or >5 s. Other embodiments are contemplated wherein instead of switching one or more ions sources ON and OFF, the one or more ion sources may instead be left substantially ON. According to this embodiment an ion source selector device such as a baffle or rotating ion beam block may be used. For example, two ion sources may be left ON but the ion beam selector preferably only allows ions from one of the ion sources to be transmitted to the mass spectrometer at any particular instant in time. Yet further embodiments are contemplated wherein on ion source may be left ON and another ion source may be switched repeatedly ON and OFF.

According to an embodiment Electron Transfer Dissociation fragmentation (and/or Proton Transfer Reaction charge state reduction) may be controlled, maximised, minimised, enhanced or substantially prevented by controlling the velocity and/or amplitude of the travelling DC voltages applied to the electrodes of the ETD or PTR device or ion guide. If the travelling DC voltages are applied to the electrodes in a very rapid manner then very few analyte ions may fragment by means of Electron Transfer Dissociation (and charge state reduction by Proton Transfer Reaction may also be substantially reduced).

Although various embodiments have been discussed wherein the reaction volume has been optimised towards the centre of the ETD or PTR reaction device, other embodiments are contemplated wherein the ETD or PTR reaction device may be optimised towards e.g. the upstream and/or downstream end of the ETD or PTR reaction device. For example, the internal diameter of the ring electrodes of the ETD or PTR device or ion guide may progressively increase or decrease towards the downstream end of the ETD or PTR reaction device. Additionally or alternatively the pitch of the ring electrodes of the ETD or PTR device or ion guide may progressively decrease or increase towards the downstream end of the ETD or PTR reaction device.

Other less preferred embodiments are contemplated wherein gas flow dynamic effects and/or pressure differential effects may be used in order to urge or force analyte ions and/or reagent ions through portions of the ETD or PTR reaction device. Gas flow dynamic effects may be used in addition to other ways or means of driving or urging ions along and through the preferred reaction device.

Ions emerging from the ETD or PTR reaction device may be subjected to ion mobility separation in a separate ion mobility separation cell or stage which is preferably arranged downstream and/or upstream of the ETD or PTR reaction device.

It is contemplated that the charge state of analyte ions may be reduced by Proton Transfer Reaction prior to the analyte ions interacting with reagent ions and/or neutral reagent gas. Additionally or alternatively, the charge state of product or fragment ions resulting from Electron Transfer Dissociation may be reduced by Proton Transfer Reaction.

It is also contemplated that analyte ions may be fragmented or otherwise caused to dissociate by transferring protons to reagent ions or neutral reagent gas.

Product or fragment ions which result from Electron Transfer Dissociation may non-covalently bond together. Embodiments of the present invention are contemplated wherein non-covalently bonded product or fragment ions may be fragmented by Collision Induced Dissociation, Surface Induced Dissociation or other fragmentation processes either in the same ETD or PTR reaction device in which Electron Transfer Dissociation was performed or more preferably in a separate reaction device or cell which is preferably arranged downstream of the ETD or PTR ion guide.

Further embodiments are contemplated wherein analyte ions may be caused to fragment or dissociate following reactions or interactions with metastable atoms or ions such as atoms or ions of xenon, caesium, helium or nitrogen.

According to another embodiment substantially the same reagent ions which are disclosed above as being suitable for use for Electron Transfer Dissociation may additionally or alternatively be used for Proton Transfer Reaction in order to reduce the charge state of the analyte ions. So for example, according to an embodiment reagent anions or negatively charged ions derived from a polyaromatic hydrocarbon or a substituted polyaromatic hydrocarbon may be used to initiate Proton Transfer Reaction. Reagent anions or negatively charged ions for use in Proton Transfer Reaction may be derived from substances selected from the group consisting of (i) anthracene; (ii) 9,10 diphenyl-anthracene; (Hi) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10-phenanthroline; (xvii) 9' anthracenecarbonitrile; and (xviii) anthraquinone. Reagent ions or negatively charged ions comprising azobenzene anions, azobenzene radical anions or other radical anions may also be used to perform Proton Transfer Reaction.

According to an embodiment neutral helium gas may be provided to the ETD or PTR reaction device at a pressure in the range 0.01-0.1 mbar, less preferably 0.001-1 mbar. Helium gas has been found to be particularly useful in supporting Electron Transfer Dissociation and/or Proton Transfer Reaction in the reaction device. Nitrogen and argon gas are less preferred and may cause at least some ions to fragment by Collision Induced Dissociation rather than by Electron Transfer Dissociation.

Embodiments are also contemplated wherein a dual mode ion source may be switched between modes or two ion sources may be switched ON/OFF in a symmetric or asymmetric manner. For example, according to an embodiment an ion source producing analyte ions may be left ON for approximately 90% of a duty cycle. For the remaining 10% of the duty cycle the ion source producing analyte ions may be switched OFF and reagent ions may be produced in order to replenish the reagent ions within the preferred reaction device. Other embodiments are contemplated wherein the ratio of the period of time during which the ion source generating analyte ions is switched ON (or analyte ions are transmitted into the mass spectrometer) relative to the period of time during which the ion source generating reagent ions is switched ON (or reagent ions are transmitted into the mass spectrometer or generated within the mass spectrometer) may fall within the range <1, 1-2, 2-3, 3-4, 4-5, 5-6, 6-7, 7-8, 8-9, 9-10, 10-15, 15-20, 20-25, 25-30, 30-35, 35-40, 40-45, 45-50 or >50.

Figure 10:
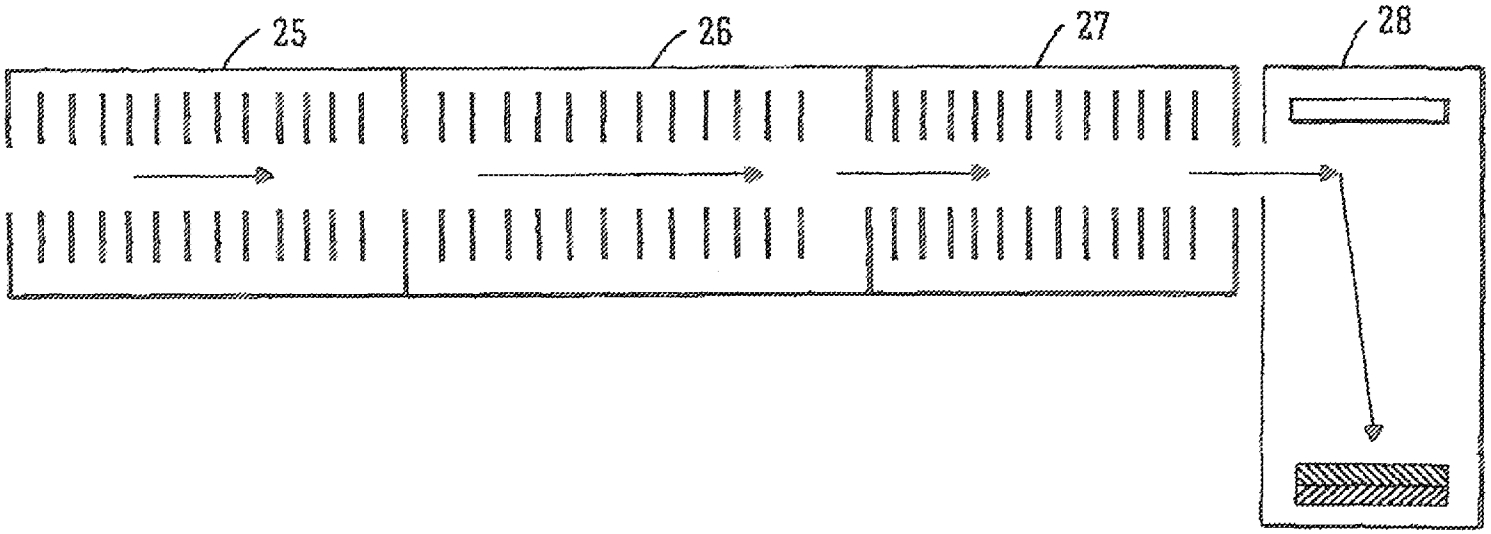
FIG. 10 shows a mass spectrometer according to an embodiment of the present invention wherein reagent anions and analyte cations are arranged to react within a first collision cell and the resulting product ions are then separated temporally in a ion mobility spectrometer which is arranged downstream of the first collision cell.

A preferred embodiment of the present invention is shown in FIG. 10 and comprises a first collision cell or ion-ion reaction cell 25 and an ion mobility device or ion mobility spectrometer or separator 26 arranged downstream of the first collision cell or ion-ion reaction cell 25. A second collision cell 27 is preferably arranged downstream of the ion mobility device or ion mobility spectrometer or separator 26.

The first collision cell or ion-ion reaction cell 25 preferably comprises an Electron Transfer Dissociation and/or Proton Transfer Reaction device 25. Reagent anions and analyte cations are preferably arranged to react within the Electron Transfer Dissociation and/or Proton Transfer Reaction device 25. A plurality of product ions differing in mass, charge state and ion mobility are preferably produced as a result of the Electron Transfer Dissociation and/or Proton Transfer Reaction processes and these ions preferably emerge from the first collision cell 25.

All the ions which emerge from the first collision cell 25 are then preferably passed through the ion mobility spectrometer or separator 26. In a mode of operation ions which emerge from the first collision cell 25 are preferably separated temporally according to their ion mobility in the ion mobility spectrometer or separator 26. In alternative modes of operation the ion mobility spectrometer or separator 26 may effectively be switched OFF so that the ion, mobility spectrometer or separator 26 operates as an ion guide wherein ions are transmitted through the ion mobility spectrometer or separator 26 without being fragmented and without being substantially temporally separated according to their ion mobility.

The ions which emerge from the ion mobility spectrometer or separator 26 then preferably pass into the second collision cell 27. In a mode of operation the second collision cell 27 may be operated as a Collision induced Dissociation ("CID") fragmentation cell by maintaining a relatively high potential difference between the exit of the ion mobility spectrometer or separator 26 and the entrance to the second collision cell 27. As a result, ions are energetically accelerated into the second collision cell 27 and are caused to fragment by CID. It is known that the product or fragment ions resulting from Electron Transfer Dissociation or Proton Transfer Reaction may form non-covalent bonds so that two or more product or fragment ions may cluster together. In a mode of operation the second collision cell 27 may be used to subject the product or fragment ions which have been formed in the first collision cell 25 to CID fragmentation so that any non-covalent bonds between the product or fragment ions are broken. This process can be considered as a form of secondary activation by CID in order to generate c-type and i-type ETD fragment ions.

A Time of Flight mass analyser 28 is preferably arranged downstream of the second collision cell 27 and is arranged to mass analyse ions which emerge from the second collision cell 27.

By monitoring the ratio of the charge reduced precursor ions using the Time of Flight mass analyser as described above, the optimal reaction conditions for ET and ETD may be set. All product ions are preferably temporally separated in the ion mobility spectrometer or separator 26 and preferably elute into the second collision cell 27. The ion mobility spectrometer or separator 26 preferably provides valuable information regarding the shape and charge of the product ions and preferably also reduces the spectral complexity of data measured by the Time of Flight mass analyser 28.

It has been observed that following electron transfer of electrons to cations then depending upon the conformation of the cation, the cations may remain intact due to non-covalent bonding. The second collision cell 27 is preferably provided to fragment gently by CCD charge reduced precursor ions and preferably enables the precursor ions to complete their dissociation into their constituent ETD type ions (i.e. c- and z-type fragment ions).

Further embodiments are contemplated wherein electron transfer and/or proton transfer may be performed in both collision cells 25,27 (and/or in the ion mobility spectrometer or separator 26). Alternatively, CID may be performed in the first collision cell 25 followed by ETD or PTR in the second collision cell 27. These variations may be useful for studying any conformation changes of ions following fragmentation by CID.

Further aspects of preferred embodiments of the present invention will now be illustrated with reference to FIGS. 11A-11C. Experiments were performed wherein triply charged analyte cations of Substance-P (having a mass to charge ratio of 449.9) were reacted with singly charged reagent anions of azobenzene (having a mass to charge ratio of 182) in a travelling wave collision cell 25 of a Waters QTOF-Premier® mass spectrometer arranged substantially as shown in FIG. 10. As a result of the reaction between the triply charged analyte cations and the reagent anions charge transfer occurred. The resulting product ions emerged from the collision cell 25 and were mass analyzed by a Time of Flight mass analyser 28. Analysis of the product ion spectra showed relatively intense peaks for doubly and singly charged charge reduced analyte ions having corresponding mass to charge ratios of 674 and 1348 under certain conditions.

The speed or velocity of the travelling wave which was translated along the length of the collision cell 25 was programmed or controlled so that the transit time of ions and hence the ion-ion reaction time between analyte cations and reagent anions was controlled or varied. If the reaction time between analyte cations and reagent anions is restricted, then the triply charged precursor analyte cations remain substantially intact and there is little evidence of charge reduction and/or fragmentation in a corresponding mass spectrum.

Figures 11A, 11B, 11C:
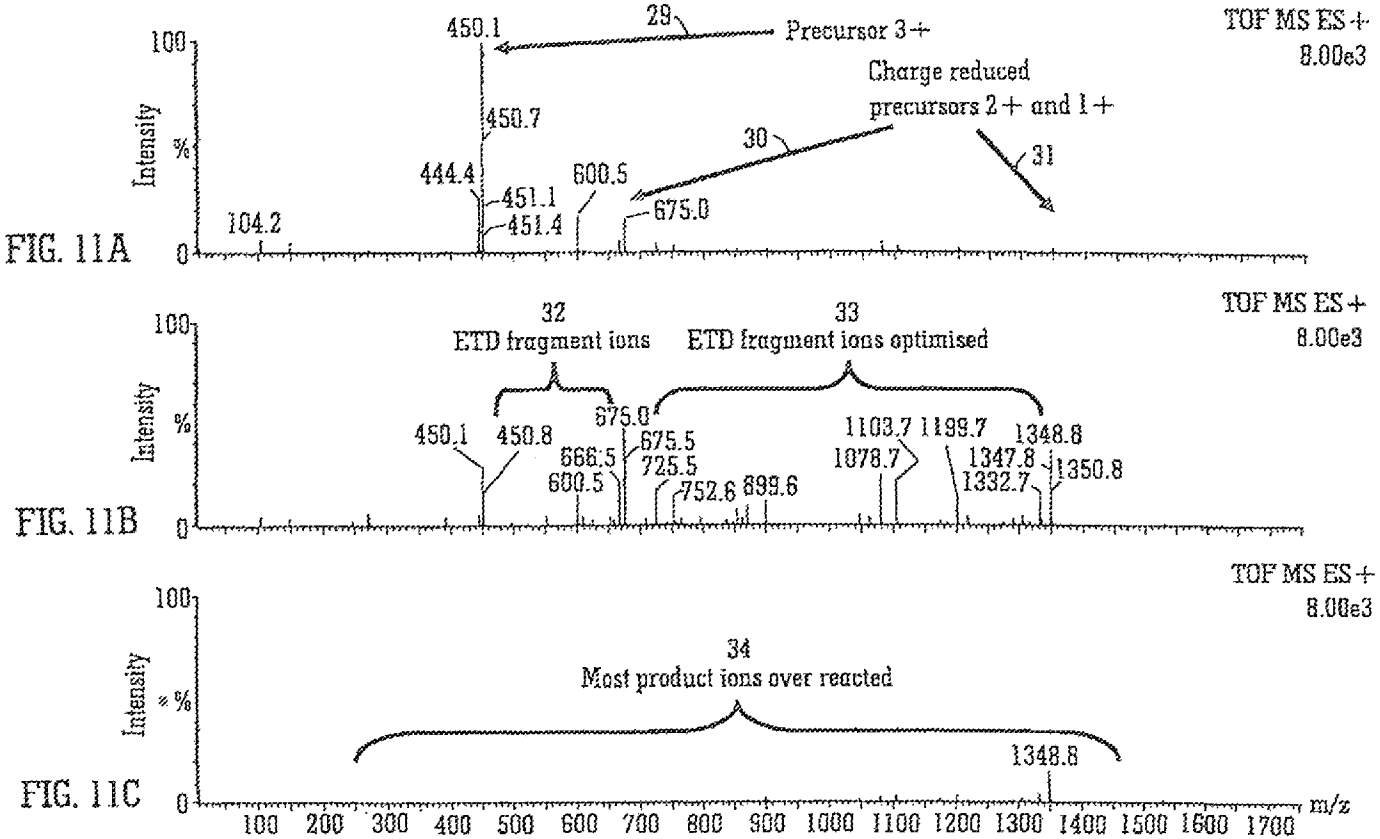
FIG. 11A shows a mass spectrum obtained according to an embodiment of the present invention wherein triply charged precursor analyte cations were transmitted with a transit time of 1.2 ms through an ETD or PTR cell together with reagent anions.
FIG. 11B shows a mass spectrum obtained according to an embodiment of the present invention wherein triply charged precursor analyte cations were transmitted with a transit time of 37 ins through an ETD or PTR cell together with reagent anions and FIG. 11C shows a mass spectrum obtained according to an embodiment of the present invention wherein triply charged precursor analyte cations were transmitted with a transit time of 305 ms through an ETD or PTR cell together with reagent anions.

FIG. 11A shows a mass spectrum obtained when the travelling wave transit time was set at 1.2 ms. It is apparent from FIG. 11A that the triply charged precursor ions 29 remained largely unfragmented and without being charge reduced. Some of the triply charged precursor ions 29 were charge reduced to become doubly charged ions 30 (having a mass to charge ratio of 674) without being subjection to fragmentation. Very few triply charged precursor ions 29 were charged reduced to become singly charged ions 31 having a mass to charge ratio of 1348.

If the ion-ion reaction is allowed to progress for a substantially longer period of time then the ratio of doubly charged (i.e. charge reduced) analyte ions to the parent or precursor triply charged analyte ions increases. ETD fragment ions in the data are also observed to increase. This is evident from FIG. 11B which shows a mass spectrum obtained with a travelling wave transit time of 37 ms. In the mass spectrum shown in FIG. 11B the intensity of doubly charged (charge reduced) analyte ions exceeds the intensity of triply charged parent or precursor ions. Also the intensity of doubly charged (charge reduced) analyte ions is approximately the same as the intensity of singly charged (charge reduced) analyte ions. A relatively large number of ETD fragment or product ions 32,33 are also observed. The relatively intensities of the triply charged parent or precursor ions and the doubly and singly charged (charge reduced) analyte ions together with the presence of a relatively large number of ETD fragment ions indicates that the ETD and PTR processes may be considered as being are substantially optimised.

If the ion-ion reaction is allowed to progress for too long then the degree of charge reduction becomes excessive and any singly charged product ions can then themselves become substantially neutralized. This results in reduced abundance of all product ions and in due course an essentially blank mass spectrum. This is evident from FIG. 11C which shows a mass spectrum obtained with a travelling wave transit time of 305 ms and shows that only a few singly charged analyte ions emerge from the ETD ion guide. The majority of the ions present in the ETD have been charged reduced and then neutralized.

Figure 12:
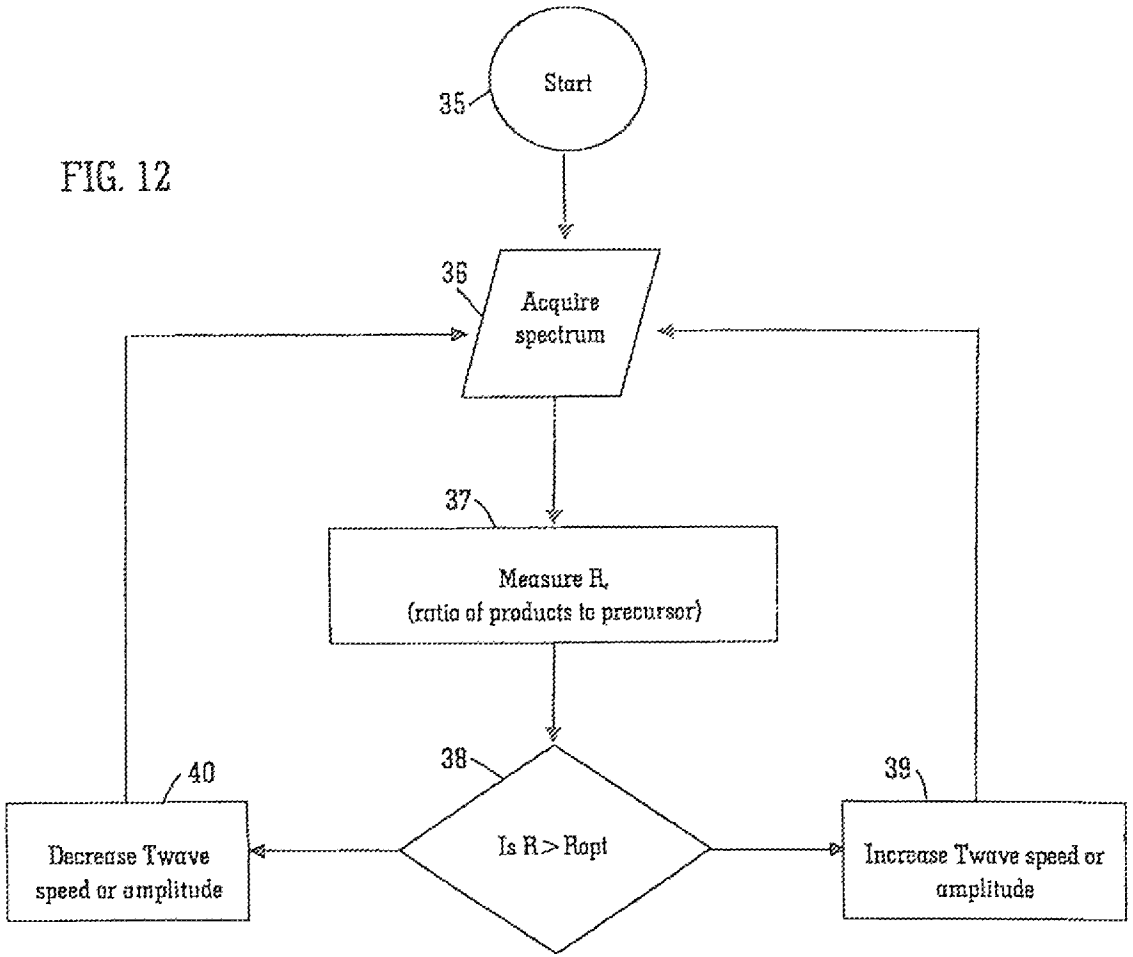
FIG. 12 shows a flow chart according to an embodiment of the present invention showing how the speed or amplitude of one or more transient DC voltages applied to the electrodes of an Electron Transfer Dissociation reaction device may be increased or decreased in order to optimise the ETD fragmentation of ions passing through the reaction device.

According to an embodiment an optimal reaction time (or travelling wave speed) may be set which corresponds with an optimal ratio (Ropt) of the abundance of charge reduced ions to non-charge reduced precursor ions. FIG. 12 shows a flow chart indicating a method of optimizing ETD in an ETD or PTR device or ion guide according to an embodiment of the present invention. According to the preferred embodiment the ratio R of the intensity of one or more charged reduced cations to the intensity of the parent cations is preferably desired to be maintained at a certain ratio. Instrumental parameters are preferably programmed or varied automatically on the fly as part of a feedback loop in order to achieve the desired ratio for the next Time of Flight spectrum. The optimal ratio is preferably kept substantially constant with time. However, less preferred embodiments are contemplated wherein the optimal or desired ratio may vary with time in a linear, stepped, curved, non-linear or other manner. For example, embodiments are contemplated wherein the ETD or FIR device may be desired to be switched once or repeatedly between a first mode wherein ETD is optimised or maximised and a second mode wherein ETD is minimised.

As shown in FIG. 12, at the start 35 of the process a mass spectrum 36 is preferably acquired of the ions emerging from an Electron Transfer Dissociation and/or Proton Transfer Reaction device according to a preferred embodiment of the present invention. The ratio R of the intensity of all (or some) of the charged reduced analyte ions to the intensity of the non-charged reduced precursor analyte ions is preferably determined 37. Then, it is determined at a subsequent step 38 whether or not the measured ratio R exceeds a desired (optimum) ratio Ropt. According to an embodiment the ratio Ropt may be set at approximately 3:1.

Embodiments are contemplated wherein the precursor analyte ions may have a charge state of 2+ and the intensity of charged reduced precursor ions having a charge state of 1+ are determined. Other embodiments are contemplated wherein the precursor analyte ions may have a charge state of 3+ and the intensity of charged reduced precursor ions having a charge state of 2+ and/or 1+ are determined. According to another embodiment, the precursor analyte ions may have a charge state of 4+ and the intensity of charged reduced precursor ions having a charge state of 3+ and/or 2+ and/or 1+ are determined. According to another embodiment, the precursor analyte ions may have a charge state of 5+ and the intensity of charged reduced precursor ions having a charge state of 4+ and/or 3+ and/or 2+ and/or 1+ are determined.

As an alternative to, or in addition to measuring the intensity or abundance of charge reduced precursor ions, the intensity or abundance of one or more fragment ions may be determined. The ratio of the intensity of one or more fragment ions to the intensity of non-charged reduced precursor ions and/or charge reduced precursor ions may preferably be determined and the control system may be arranged to optimise, maximise or minimise this ratio.

According to a preferred feedback control mechanism, if R<Ropt then it may be considered that an insufficient number of precursor ions are being subjected to ETD. In order to connect this, the DC travelling wave speed and/or the amplitude of the DC travelling wave is preferably reduced at step 40 thereby increasing ion-ion reaction times and hence increasing the number of precursor ions which then become subject to ETD.

Conversely, if R>Ropt then it may be considered that the ETD process is too dominant in which case the DC travelling wave speed and/or the amplitude of the DC travelling wave is preferably increased at step 39 thereby reducing ion-ion reaction times and hence reducing the effects of ETD.

In order to attain the desired ratio, other parameters that affect the ion-ion reaction rate such as the amplitude of the travelling DC voltage wave, the amplitude and frequency of an AC or RF voltage applied to the collision cell (and low mass cut off) in order to confine ions radially in the ETD or PTR device, the anion or cation source conditions, and the ETD or PTR ion guide voltages may also be programmed as part of the DDA method according to an embodiment of the present invention.

The effect of varying the amplitude of the travelling wave DC voltage applied to the Electron Transfer Dissociation and/or Proton Transfer Reaction device on the ETD fragmentation of triply charged Substance-P having a mass to charge ratio of 449.9 due to reactions with azobenzene reagent ions is shown in FIGS. 13A-13E.

Figure 13A:
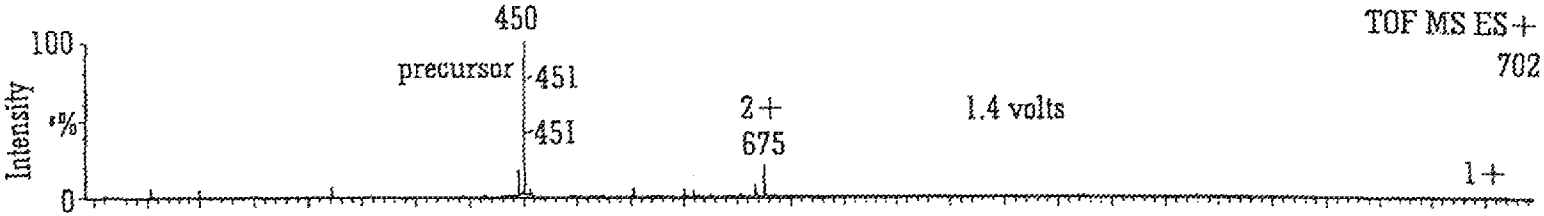
FIG. 13A shows a mass spectrum obtained when a DC travelling wave having an amplitude of 1.4 V was applied to the electrodes of an Electron Transfer Dissociation ion guide.
Figure 13B:
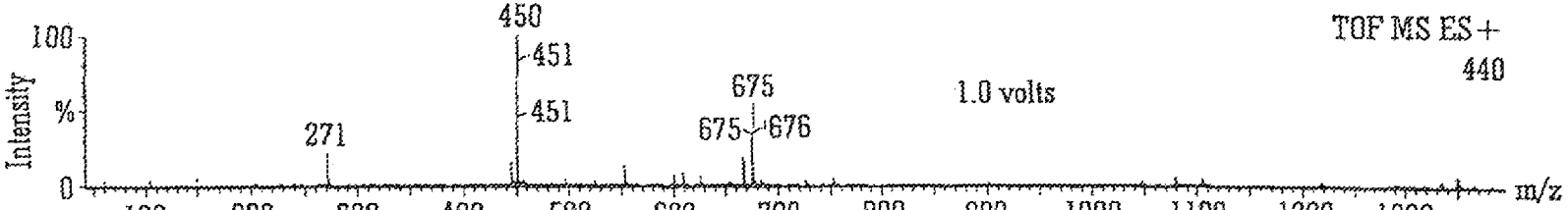
FIG. 13B shows a mass spectrum obtained when a DC travelling wave having an amplitude of 1.0 V was applied to the electrodes of an Electron Transfer Dissociation ion guide.
Figure 13C:
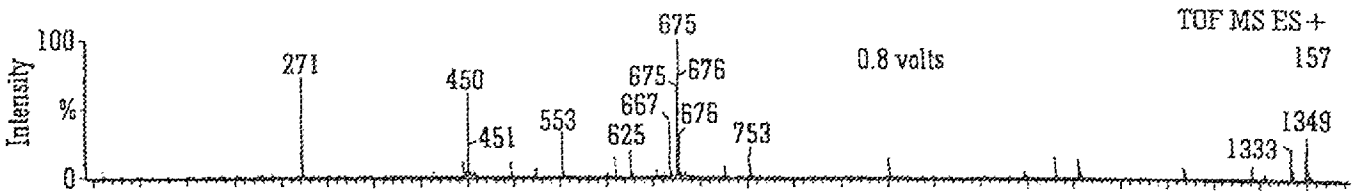
FIG. 13C shows a mass spectrum obtained when a DC travelling wave having an amplitude of 0.8 V was applied to the electrodes of an Electron Transfer Dissociation ion guide.
Figure 13D:
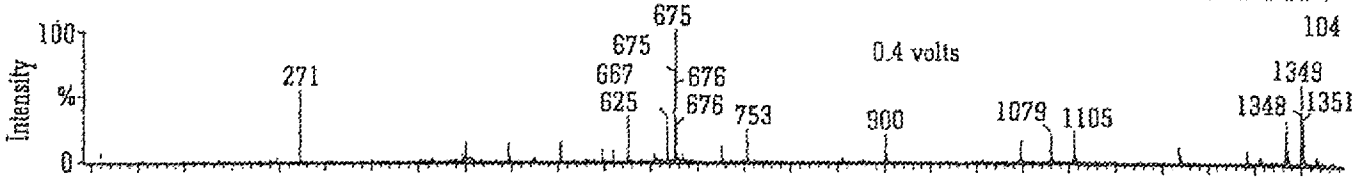
FIG. 13D shows a mass spectrum obtained when a DC travelling wave having an amplitude of 0.4 V was applied to the electrodes of an Electron Transfer Dissociation ion guide

FIG. 13A shows a mass spectrum obtained when a travelling wave DC voltage having an amplitude of 1.4 V was applied to the electrodes of an Electron Transfer Dissociation device or ion guide. FIG. 13B shows a mass spectrum obtained when a travelling wave DC voltage having an amplitude of 1.0 V was applied to the electrodes of an Electron Transfer Dissociation device or ion guide, FIG. 13C shows a mass spectrum obtained when a travelling wave DC voltage having an amplitude of 0.8 V was applied to the electrodes of an Electron Transfer Dissociation device or ion guide. FIG. 13D shows a mass spectrum obtained when a travelling wave DC voltage having an amplitude of 0.4 V was applied to the electrodes of an Electron Transfer Dissociation device or ion guide and FIG. 13E shows a mass spectrum obtained when a travelling wave DC voltage having an amplitude of 0.1 V was applied to the electrodes of an Electron Transfer Dissociation device or ion guide.

Figure 13E:
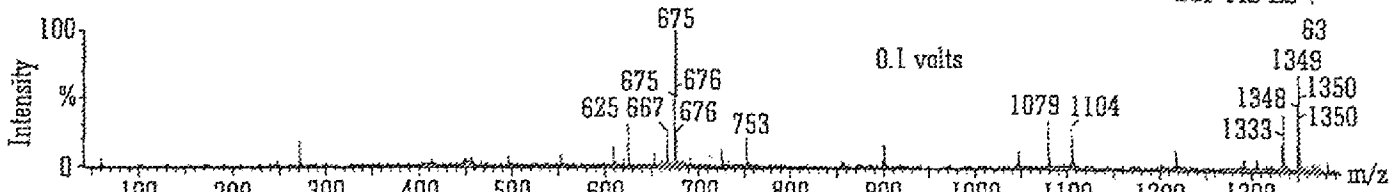
FIG. 13E shows a mass spectrum obtained when a DC travelling wave having an amplitude of 0.1 V was applied to the electrodes of an Electron Transfer Dissociation ion guide.

Considering the different mass spectra shown in FIGS. 13A-13E, optimum ETD conditions are observed when the amplitude of the travelling wave DC voltage was set at 0.8 V as shown in FIG. 13C. This is evident from comparing the intensities of the triply charged precursor ions having a mass to charge ratio of 450 with the intensity of doubly charged (i.e. charge reduced) analyte ions having a mass to charge ratio of 675 and singly charged (i.e. charge reduced) analyte ions having a mass to charge ratio of 1349. As is evident from FIG. 13A, if the travelling wave DC voltage is set too high then precursor ions are confined in their DC potential wells as the DC travelling wave is translated along the length of the ETD device or ion guide. As a result, the triply charged precursor ions remain substantially unfragmented and only a small proportion of the precursor ions are charge reduced to become doubly charged ions. Conversely, as shown in FIG. 13E, if the travelling wave DC voltage is set too low then the effect of the DC travelling wave in terms of urging ions through and along the ETD device or ion guide is significantly reduced. As a result, ion-ion reaction times are significantly increased leading to significant charge reduction and ETD fragmentation effects being observed.

Although the preferred embodiment relates to performing ETD and/or PTR in an ion guide or device comprising a plurality of electrodes having apertures through which ions are transmitted, other embodiments are contemplated wherein the ETD or PTR device comprises a plurality of rod electrodes. A DC voltage gradient is preferably applied along at least a portion of the axial length of the rod set. If the control system determines that the degree of ETD fragmentation and/or PTR charge reduction is too high, then the DC voltage gradient is preferably increased so that the ion-ion reaction times between analyte ions and reagent ions is reduced. Similarly, if the control system determines that the degree of ETD fragmentation and/or PTR charge reduction is too low, then the DC voltage gradient is preferably decreased so that the ion-ion reaction times between analyte ions and reagent ions is increased. Other embodiments are contemplated wherein, a neutral reagent gas may be used instead of reagent ions.

According to another embodiment the control system may be arranged and adapted to vary the degree of radial RE confinement within a radial pseudo-potential well. If the RF voltage applied to the electrodes of the ETD or PTR device or ion guide is increased, then the pseudo-potential well will have a narrower profile leading to a reduced ion-ion reaction volume. As a result, there will be greater interaction between analyte ions and reagent ions leading to increased ETD and/or PTR effects. If the control system determines that the degree of ETD fragmentation and/or PTR charge reduction is too high, then the RF voltage may be reduced so that there is less mixing between analyte ions and reagent ions. Similarly, if the control system determines that the degree of ETD fragmentation and/or PTR charge reduction is too low, then the RF voltage may be increased so that there is increased mixing between analyte ions and reagent ions.

According to another embodiment negative reagent ions may be trapped within the ETD or PTR device or ion guide by applying a negative potential at one or both ends of the ETD or PTR device or ion guide. If the potential barrier is too low, then the ETD or PTR device or ion guide may be considered to be relatively leaky in terms of reagent ions. However, the negative potential barrier will also have the effect of accelerating positive analyte ions along and through the ETD or PTR device or ion guide. Therefore, overall if the negative potential barrier(s) are set relatively low then the ion-ion reaction time is preferably increased and there is an increased reaction cross-section leading to increased ETD fragmentation. If the control system determines that the degree of ETD fragmentation and/or PTR charge reduction is too high, then the potential barrier is preferably increased so that there is less mixing between analyte ions and reagent ions. Similarly, if the control system determines that the degree of ETD fragmentation and/or PTR charge reduction is too low, then the potential barrier is preferably decreased so that there is increased mixing between analyte ions and reagent ions.

Although the emphasis of the preferred embodiment has been upon the control system according to the preferred embodiment interrogating and analysing mass spectra produced by a mass analyser in real time, less preferred embodiments are contemplated wherein the control system may additionally or alternatively interrogate and analyse ion mobility spectra resulting from the temporal separation of ions emerging from a preferred ETD and/or PTR reaction device and then being transmitted to an ion mobility spectrometer or separator.

Embodiments of the present invention are contemplated wherein a mass spectrometer may perform multiple different analyses of ions which may, for example, being eluting from a Liquid Chromatography column. According to an embodiment, within the timescale of an LC elution peak, the analyte ions may, for example, be subjected to a parent ion scan in order to determine the mass to charge ratio(s) of the parent or precursor ions. Parent or precursor ions may then be mass selected by a quadrupole or other mass filter and subjected to CID fragmentation in order to produce and then mass analyse b-type and y-type fragment ions. The parent or precursor ions may then be mass selected by a quadrupole or other mass filter and may then be subjected to MD fragmentation in order to produce and then mass analyse c-type and z-type fragment ions. In a further mode of operation parent or precursor ions may be subjected to high/low switching of a collision cell. According to this embodiment the parent or precursor ions are repeatedly switched between two different modes of operation. In the first mode of operation the parent or precursor ions are subjected to CID or ETD fragmentation. In the second mode of operation the parent or precursor ions are not substantially subjected to CID or EID fragmentation.

Another embodiment is contemplated and will be described with reference to FIG. 10. According to this embodiment a dual-mode ETD/CID mass spectrometer may be provided wherein the first collision cell 25 is preferably provided with helium collision gas and the first collision cell 25 is preferably operated as an ETD collision cell. An ion mobility spectrometer or separator 26 is preferably provided downstream of the first collision cell 25 and is preferably arranged to separate ions temporally according to their ion mobility. A second collision 27 is preferably arranged downstream of the ion mobility spectrometer or separator 26 and is preferably provided with argon collision gas.

In a mode of operation, the ETD collision cell 25 can effectively be switched OFF. This may be achieved by arranging for precursor ions to be transmitted through the ETD collision cell 25 very rapidly such that they do not have sufficient time to fragment by ETD with reagent ions. The precursor ions are then separated temporally as they pass through the ion mobility spectrometer or separator 26. The potential difference between the exit region of the ion mobility spectrometer or separator 26 and the entrance region of the second collision cell 27 is preferably increased to a level such that precursor ions which emerge from the ion mobility spectrometer or separator 26 are caused to fragment by CID upon entering or being accelerated into the second collision 27.

In another mode of operation, the ETD collision cell 25 can effectively be switched ON and precursor ions may be arranged to be fragmented by ETD in a optimal manner within the ETD collision cell 25. This may be achieved by arranging for precursor ions to be transmitted through the ETD collision cell 25 at a velocity which optimises the ETD fragmentation process. The velocity or other parameters which affect the degree of ETD fragmentation are preferably optimised by a control system arranged according to the preferred embodiment. The resulting fragment or product ions are then preferably separated temporally as they pass through the ion mobility spectrometer or separator 26. The potential difference between the exit region of the ion mobility spectrometer or separator 26 and the entrance region of the second collision cell 27 is preferably reduced to a level such that fragment or precursor ions which emerge from the ion mobility spectrometer or separator 26 are not fragmented by CID as they enter and pass through the second collision 27.

Other less preferred embodiments are contemplated wherein different parameters may additionally or alternatively be varied in order to optimise the degree of fragmentation of precursor ions by ETD. It is contemplated, for example, that the pressure of the ETD reaction cell may be varied in order to control and/or optimise the fragmentation of ions by ETD. It is also contemplated that the number of reagent ions arranged to present within the ETD reaction cell could be varied in real time in order to control and/or optimise the fragmentation of ions by ETD. It is also contemplated that the kinetic energy of analyte ions entering the ETD reaction cell could be varied in order to control and/or optimise the fragmentation of ions by ETD. It is also contemplated that additional reagent ions could be controllably introduced into the ETD reaction cell in real time in order to control and/or optimise the fragmentation of ions by ETD.

Finally, the ions which are fragmented and/or reduced in charge may according to an embodiment comprise peptide ions derived from peptides which have been subject to hydrogen-deuterium ("H-D") exchange. Hydrogen-deuterium exchange is a chemical reaction wherein a covalently bonded hydrogen atom is replaced with a deuterium atom. In view of the fact that a deuterium nucleus is heavier than hydrogen due to the addition of an extra neutron, then a protein or peptide comprising some deuterium will be heavier than one that contains all hydrogen. As a result, as a protein or peptide is increasingly deuterated then the molecular mass will steadily increase and this increase in molecular mass can be detected by mass spectrometry. It is therefore contemplated that the preferred method may be used in the analysis of proteins or peptides incorporating deuterium. The incorporation of deuterium may be used to study both the structural dynamics of proteins in solution (e.g. by hydrogen-exchange mass spectrometry) as well as the gas phase structure and fragmentation mechanisms of polypeptide ions. A particularly advantageous effect of Electron Transfer Dissociation of peptides is that ETD fragmentation (unlike CID fragmentation) does not suffer from the problem of hydrogen scrambling which is the intramolecular migration of hydrogens upon vibrational excitation of the even-electron precursor ion. According to an embodiment of the present invention the preferred apparatus and method may be used to effect ETD fragmentation and/or PTR charge reduction of peptide ions comprising deuterium. According to an embodiment the degree of ETD fragmentation and/or PTR charge reduction of peptide ions comprising deuterium may be controlled, optimised, maximised or minimised. Similarly, the degree of hydrogen scrambling in peptide ions comprising deuterium prior to fragmentation of the ions by ETD and/or charge reduction by PTR may be controlled, optimised, maximised or minimised according to an embodiment of the present invention by varying, altering, increasing or decreasing one or more parameters (e.g. travelling wave velocity and/or amplitude) which affect the transmission of ions through the ion guide.

Although the present invention has been described with reference to preferred embodiments, it will be understood by those skilled in the art that various changes in form and detail nay be made without departing from the scope of the invention as set forth in the accompanying claims.

The invention claimed is:

1. A mass spectrometer comprising:

an Electron Transfer Dissociation or Proton Transfer Reaction device comprising an ion guide comprising a plurality of electrodes;

a first device arranged and adapted to drive or urge at least some first ions to pass through or along said ion guide, wherein said first device is arranged and adapted either:

(i) to generate a linear axial DC electric field along at least a portion or along at least 1%, 5%, 10%, 20%, 30%, 40%, 50%, 60%, 70%, 80%, 90%, 95% or 100% of an axial length of said ion guide; or (ii) to generate a non-linear or stepped axial DC electric field along at least a portion or along at least 1%, 5%, 10%, 20%, 30%, 40%, 50%, 60%, 70%, 80%, 90%, 95% or 100% of the axial length of said ion guide; and a control system arranged and adapted to estimate, determine or measure a degree to which at least some first ions are fragmented or reduced in charge due to Electron Transfer Dissociation or Proton Transfer Reaction as said first ions are transmitted through said ion guide and in response thereto to vary, alter, increase or decrease one or more parameters which affect the transmission or degree of fragmentation or degree of charge reduction of said first ions as said first ions pass through said ion guide.

2. A mass spectrometer as claimed in claim 1, wherein said first ions comprise either:

(i) anions or negatively charged ions;

(ii) cations or positively charged ions; or (iii) a combination or mixture of anions and cations.

3. A mass spectrometer as claimed in claim 1, wherein in a mode of operation said control system is arranged and adapted to vary, alter, increase or decrease said one or more parameters in order to optimise or maximise a fragmentation or charge reduction of said first ions as said first ions pass through said ion guide.

4. A mass spectrometer as claimed in claim 1, wherein in a mode of operation said control system is arranged and adapted to vary, alter, increase or decrease said one or more parameters in order to minimise or reduce a fragmentation or charge reduction of said first ions so that said ion guide is operated in an ion guiding mode wherein ions received at the input to said ion guide are substantially onwardly transmitted to the output of said ion guide without substantially being subjected to fragmentation or charge reduction.

5. A mass spectrometer as claimed in claim 1, wherein said control system is arranged and adapted to vary, alter, increase or decrease said one or more parameters so as to vary, alter, increase or decrease a speed or velocity at which said first ions are transmitted, in use, through said ion guide.

6. A mass spectrometer as claimed in claim 1, wherein said control system is arranged and adapted to vary, alter, increase or decrease said axial DC electric field or a gradient of said axial DC electric field.

7. A mass spectrometer as claimed in claim 1, further comprising a first RF device arranged and adapted to apply a first AC or RF voltage having a first frequency and a first amplitude to at least some of said plurality of electrodes such that, in use, ions are confined radially within said ion guide, wherein either:

(a) said first frequency is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; or (b) said first amplitude is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; or (c) in a mode of operation adjacent or neighbouring electrodes are supplied with opposite phase of said first AC or RF voltage; or (d) said ion guide comprises 1-10, 10-20, 20-30, 30-40, 40-50, 50-60, 60-70, 70-80, 80-90, 90-100 or >100 groups of electrodes, wherein each group of electrodes comprises at least 1, 2, 3, 4, 5, 6, 7, 8, 9, 10, 11, 12, 13, 14, 15, 16, 17, 18, 19 or 20 electrodes and wherein at least 1, 2, 3, 4, 5, 6, 7, 8, 9, 10, 11, 12, 13, 14, 15, 16, 17, 18, 19 or 20 electrodes in each group are supplied with the same phase of said first AC or RF voltage.

8. A mass spectrometer as claimed in claim 7, wherein said control system is arranged and adapted to vary, alter, increase or decrease said first frequency or said first amplitude in order to vary, alter, increase or decrease the degree or amount of ion confinement or ion-ion interactions within said ion guide.

9. A mass spectrometer as claimed in claim 1, wherein said control system is arranged and adapted to estimate, determine or measure a degree to which at least some of said first ions are fragmented or reduced in charge by estimating, determining or measuring either:

(i) an intensity or abundance of one or more first parent, precursor, daughter, fragment, charged reduced or other ions observed within a mass spectrum, an ion mobility spectrum or other spectrum; or (ii) an intensity or abundance of one or more first parent, precursor, daughter, fragment, charged reduced or other ions observed within a first mass range or a first mass to charge ratio range of a mass spectrum, an ion mobility spectrum or other spectrum.

10. A mass spectrometer as claimed in claim 1, wherein said control system is arranged and adapted to estimate, determine or measure a degree to which at least some of said first ions are fragmented or reduced in charge by estimating, determining or measuring a intensity or abundance of one or more first parent, precursor, daughter, fragment, charged reduced or other ions within a first mass range or a first mass to charge ratio range of a mass spectrum or an ion mobility spectrum relative to an intensity or abundance of one or more second parent, precursor, daughter, fragment, charged reduced or others ions.

11. A mass spectrometer as claimed in claim 1, wherein said control system is arranged and adapted to vary, alter, increase or decrease a degree to which at least some of said first ions are fragmented or reduced in charge in order to maintain an ion abundance measurement, an ion intensity measurement or an ion ratio at a desired value or within a desired range.

12. A mass spectrometer as claimed in claim 1, wherein if said control system determines that an ion abundance measurement, an ion intensity measurement or an ion ratio is relatively high or exceeds a threshold then said control system is arranged and adapted to vary, alter, increase or decrease said one or more parameters.

13. A mass spectrometer as claimed in claim 1, if said control system determines that an ion abundance measurement, an ion intensity measurement or an ion ratio is relatively low or falls below a threshold then said control system is arranged and adapted to vary, alter, increase or decrease said one or more parameters.

14. A mass spectrometer as claimed in claim 1, wherein said ion guide comprises a plurality of electrodes having at least one aperture, wherein ions are transmitted in use through said apertures.

15. A mass spectrometer as claimed in claim 1, wherein either:

(a) at least 1%, 5%, 10%, 20%, 30%, 40%, 50%, 60%, 70%, 80%, 90%, 95% or 100% of said electrodes have substantially circular, rectangular, square or elliptical apertures; or (b) at least 1%, 5%, 10%, 20%, 30%, 40%, 50%, 60%, 70%, 80%, 90%, 95% or 100% of said electrodes have apertures which are substantially the same first size or which have substantially the same first area or at least 1%, 5%, 10%, 20%, 30%, 40%, 50%, 60%, 70%, 80%, 90%, 95% or 100% of said electrodes have apertures which are substantially the same second different size or which have substantially the same second different area; or (c) at least 1%, 5%, 10%, 20%, 30%, 40%, 50%, 60%, 70%, 80%, 90%, 95% or 100% of said electrodes have apertures which become progressively larger or smaller in size or in area in a direction along the axis of said ion guide; or (d) at least 1%, 5%, 10%, 20%, 30%, 40%, 50%, 60%, 70%, 80%, 90%, 95% or 100% of said electrodes have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm; or (e) at least 1%, 5%, 10%, 20%, 30%, 40%, 50%, 60%, 70%, 80%, 90%, 95% or 100% of said electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; or (f) at least some of said plurality of electrodes comprise apertures and wherein the ratio of the internal diameter or dimension of said apertures to the centre-to-centre axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; or (g) the internal diameter of the apertures of said plurality of electrodes progressively increases or decreases and then progressively decreases or increases one or more times along the longitudinal axis of said ion guide; or (h) said plurality of electrodes define a geometric volume, wherein said geometric volume is selected from the group consisting of: (i) one or more spheres; (ii) one or more oblate spheroids; (iii) one or more prolate spheroids; (iv) one or more ellipsoids; and (v) one or more scalene ellipsoids; or (i) said ion guide has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm; or (j) said ion guide comprises at least: (i) 1-10 electrodes; (ii) 10-20 electrodes; (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-110 electrodes; (xii) 110-120 electrodes; (xiii) 120-130 electrodes; (xiv) 130-140 electrodes; (xv) 140-150 electrodes; (xvi) 150-160 electrodes; (xvii) 160-170 electrodes; (xviii) 170-180 electrodes; (xix) 180-190 electrodes; (xx) 190-200 electrodes; and (xxi) >200 electrodes; or (k) at least 1%, 5%, 10%, 20%, 30%, 40%, 50%, 60%, 70%, 80%, 90%, 95% or 100% of said electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 min; (xii) less than or equal to 0.4 mm; (xiii) less than or equal to 0.2 mm; (xiv) less than or equal to 0.1 mm; and (xv) less than or equal to 0.25 mm; or (l) the pitch or axial spacing of said plurality of electrodes progressively decreases or increases one or more times along the longitudinal axis of said ion guide.

16. A mass spectrometer as claimed in claim 1, wherein said ion guide comprises a plurality of segmented rod electrodes.

17. A mass spectrometer as claimed in claim 1, wherein:

(a) a static ion-ion reaction region, ion-neutral gas reaction region or reaction volume is formed or generated in said ion guide; or (b) a dynamic ion-ion reaction region, ion-neutral gas reaction region or reaction volume is formed or generated in said ion guide.

18. A mass spectrometer as claimed in claim 1, further comprising a device arranged and adapted either:

(a) to maintain said ion guide in a mode of operation at a pressure selected from the group consisting of: (i)<100 mbar; (ii)<10 mbar; (iii)<1 mbar; (iv)<0.1 mbar; (v) <0.01 mbar; (vi)<0.001 mbar; (vii)<0.0001 mbar; and (viii)<0.00001 mbar; or (b) to maintain said ion guide in a mode of operation at a pressure selected from the group consisting of: (i) >100 mbar; (ii) >10 mbar; (iii) >1 mbar; (iv) >0.1 mbar; (v) >0.01 mbar; (vi) >0.001 mbar; and (vii) >0.0001 mbar; or (c) to maintain said ion guide in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

19. A mass spectrometer as claimed in claim 1, wherein:

(a) a residence, transit or reaction time of at least 1%, 5%, 10%, 20%, 30%, 40%, 50%, 60%, 70%, 80%, 90%, 95% or 100% of said first ions within said ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms; or (b) the residence, transit or reaction time of at least 1%, 5%, 10%, 20%, 30%, 40%, 50%, 60%, 70%, 80%, 90%, 95% or 100% of second ions within said ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms; or (c) the residence, transit or reaction time of at least 1%, 5%, 10%, 20%, 30%, 40%, 50%, 60%, 70%, 80%, 90%, 95% or 100% of product or fragment ions created or formed within said ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms; or (d) said ion guide has a cycle time selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

20. A mass spectrometer as claimed in claim 1, wherein:

(a) in a mode of operation first ions or second ions are arranged and adapted to be trapped but not substantially fragmented or reacted or charge reduced within said ion guide; or (b) in a mode of operation first ions or second ions are arranged and adapted to be collisionally cooled or substantially thermalised within said ion guide; or (c) in a mode of operation first ions or second ions are arranged and adapted to be substantially fragmented or reacted or charge reduced within said ion guide; or (d) in a mode of operation first ions or second ions are arranged and adapted to be pulsed into or out of said ion guide by means of one or more electrodes arranged at an entrance or exit of said ion guide.

21. A mass spectrometer as claimed in claim 1, wherein:

(a) in a mode of operation ions are predominantly arranged to fragment by Collision Induced Dissociation to form product or fragment ions, wherein said product or fragment ions comprise a majority of b-type product or fragment ions or y-type product or fragment ions; or (b) in a mode of operation ions are predominantly arranged to fragment by Electron Transfer Dissociation to form product or fragment ions, wherein said product or fragment ions comprise a majority of c-type product or fragment ions or z-type product or fragment ions.

22. A mass spectrometer as claimed in claim 1, wherein in order to effect Electron Transfer Dissociation either:

(a) analyte ions are fragmented or are induced to dissociate and form product or fragment ions upon interacting with reagent ions; or (b) electrons are transferred from one or more reagent anions or negatively charged ions to one or more multiply charged analyte cations or positively charged ions whereupon at least some of said multiply charged analyte cations or positively charged ions are induced to dissociate and form product or fragment ions; or (c) analyte ions are fragmented or are induced to dissociate and form product or fragment ions upon interacting with neutral reagent gas molecules or atoms or a non-ionic reagent gas; or (d) electrons are transferred from one or more neutral, non-ionic or uncharged basic gases or vapours to one or more multiply charged analyte cations or positively charged ions whereupon at least some of said multiply charged analyte cations or positively charged ions are induced to dissociate and form product or fragment ions; or (e) electrons are transferred from one or more neutral, non-ionic or uncharged superbase reagent gases or vapours to one or more multiply charged analyte cations or positively charged ions whereupon at least some of said multiply charge analyte cations or positively charged ions are induced to dissociate and form product or fragment ions; or (f) electrons are transferred from one or more neutral, non-ionic or uncharged alkali metal gases or vapours to one or more multiply charged analyte cations or positively charged ions whereupon at least some of said multiply charged analyte cations or positively charged ions are induced to dissociate and form product or fragment ions; or (g) electrons are transferred from one or more neutral, non-ionic or uncharged gases, vapours or atoms to one or more multiply charged analyte cations or positively charged ions whereupon at least some of said multiply charged analyte cations or positively charged ions are induced to dissociate and form product or fragment ions, wherein said one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

23. A mass spectrometer as claimed in claim 22, wherein said multiply charged analyte cations or positively charged ions comprise peptides, polypeptides, proteins or biomolecules.

24. A mass spectrometer as claimed in claim 22, wherein in order to effect Electron Transfer Dissociation:

(a) said reagent anions or negatively charged ions are derived from a polyaromatic hydrocarbon or a substituted polyaromatic hydrocarbon; or (b) said reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; or (c) said reagent ions or negatively charged ions comprise azobenzene anions or azobenzene radical anions.

25. A mass spectrometer as claimed in claim 1, wherein in order to effect Proton Transfer Reaction either:

(i) protons are transferred from one or more multiply charged analyte cations or positively charged ions to one or more reagent anions or negatively charged ions whereupon at least some of said multiply charged analyte cations or positively charged ions are reduced in charge state or are induced to dissociate and form product or fragment ions; or (ii) protons are transferred from one or more multiply charged analyte cations or positively charged ions to one or more neutral, non-ionic or uncharged reagent gases or vapours whereupon at least some of said multiply charged analyte cations or positively charged ions are reduced in charge state or are induced to dissociate and form product or fragment ions.

26. A mass spectrometer as claimed in claim 25, wherein said multiply charged analyte cations or positively charged ions comprise peptides, polypeptides, proteins or biomolecules.

27. A mass spectrometer as claimed in claim 25, wherein in order to effect Proton Transfer Reaction either:

(a) said reagent anions or negatively charged ions are derived from a compound selected from the group consisting of: (i) carboxylic acid; (ii) phenolic; and (iii) a compound containing alkoxide; or (b) said reagent anions or negatively charged ions are derived from a compound selected from the group consisting of: (i) benzoic acid; (ii) perfluoro-1,3-dimethylcyclohexane or PDCH; (iii) sulphur hexafluoride or SF6; and (iv) perfluorotributylamine or PFTBA; or (c) said one or more reagent gases or vapours comprise a superbase gas; or (d) said one or more reagent gases or vapours are selected from the group consisting of: (i) 1,1,3,3-Tetramethylguanidine ("TMG"); (ii) 2,3,4,6,7,8,9,10-Octahydropyrimidol[1,2-a]azepine {Synonym: 1,8-Diazabicyclo[5.4.0]undec-7-ene ("DBU")}; or (iii) 7-Methyl-1,5,7-triazabicyclo[4.4.0]dec-5-ene ("MTBD"){Synonym: 1,3,4,6,7,8-Hexahydro-1-methyl-2H-pyrimido[1,2-a]pyrimidine}.

28. A mass spectrometer as claimed in claim 1, further comprising either:

(a) an ion source arranged upstream or downstream of said Electron Transfer Dissociation or Proton Transfer Reaction device, wherein said ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; or (b) one or more continuous or pulsed ion sources; or (c) one or more ion guides arranged upstream or downstream of said Electron Transfer Dissociation or Proton Transfer Reaction device; or (d) one or more ion mobility separation devices or one or more Field Asymmetric Ion Mobility Spectrometer devices arranged upstream or downstream of said Electron Transfer Dissociation or Proton Transfer Reaction device; or (e) one or more ion traps or one or more ion trapping regions arranged upstream or downstream of said Electron Transfer Dissociation or Proton Transfer Reaction device; or (f) one or more collision, fragmentation or reaction cells arranged upstream or downstream of said Electron Transfer Dissociation or Proton Transfer Reaction device, wherein said one or more collision, fragmentation or reaction cells are selected from the group consisting of (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; or (h) one or more energy analysers or electrostatic energy analysers arranged upstream or downstream of said Electron Transfer Dissociation or Proton Transfer Reaction device; or (i) one or more ion detectors arranged upstream or downstream of said Electron Transfer Dissociation or Proton Transfer Reaction device; or (j) one or more mass filters arranged upstream or downstream of said Electron Transfer Dissociation or Proton Transfer Reaction device, wherein said one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; or (k) a device or ion gate for pulsing ions into said Electron Transfer Dissociation or Proton Transfer Reaction device; or (l) a device for converting a substantially continuous ion beam into a pulsed ion beam.

29. A mass spectrometer as claimed in claim 1, wherein said mass spectrometer comprises:

a C-trap; and a mass analyser;

wherein in a first mode of operation ions are transmitted to said C-trap and are then injected into said mass analyser; and wherein in a second mode of operation ions are transmitted to said C-trap and then to a collision cell or Electron Transfer Dissociation or Proton Transfer Reaction device wherein at least some ions are fragmented into fragment ions, and wherein said fragment ions are then transmitted to said C-trap before being injected into said mass analyser.

30. A method of mass spectrometry comprising:

providing an Electron Transfer Dissociation or Proton Transfer Reaction device comprising an ion guide comprising a plurality of electrodes;

driving or urging at least some of first ions to pass through or along said ion guide;

generating either: (i) a linear axial DC electric field along at least a portion or along at least 1%, 5%, 10%, 20%, 30%, 40%, 50%, 60%, 70%, 80%, 90%, 95% or 100% of an axial length of said ion guide; or (ii) a non-linear or stepped axial DC electric field along at least a portion or along at least 1%, 5%, 10%, 20%, 30%, 40%, 50%, 60%, 70%, 80%, 90%, 95% or 100% of the axial length of said ion guide; and estimating, determining or measuring a degree to which at least some first ions are fragmented or reduced in charge due to Electron Transfer Dissociation or Proton Transfer Reaction as said first ions are transmitted through said ion guide and in response thereto to varying, altering, increasing or decreasing one or more parameters which affect the transmission or degree of fragmentation or degree of charge reduction of said first ions as said first ions pass through said ion guide.

31. A mass spectrometer comprising:

an ion-neutral gas reaction device comprising an ion guide comprising a plurality of electrodes; and a control system arranged and adapted to estimate, determine or measure a degree to which at least some first ions are reacted as said first ions are transmitted through said ion guide and in response thereto to vary, alter, increase or decrease one or more parameters which affect the transmission or degree of reaction of said first ions as said first ions pass through said ion guide.

32. A method of mass spectrometry comprising:

providing an ion-neutral gas reaction device comprising an ion guide comprising a plurality of electrodes; and estimating, determining or measuring a degree to which at least some first ions are reacted as said first ions are transmitted through said ion guide and in response thereto varying, altering, increasing or decreasing one or more parameters which affect the transmission or degree of reaction of said first ions as said first ions pass through said ion guide.

* * * * *